US011618864B2

(12) United States Patent
Panandiker et al.

(10) Patent No.: US 11,618,864 B2
(45) Date of Patent: Apr. 4, 2023

(54) FRAGRANCE PREMIX COMPOSITION COMPRISING A SILICONE POLYMER AND AMINOFUNCTIONAL MATERIAL

(71) Applicant: The Procter & Gamble Company, Cincinnati, OH (US)

(72) Inventors: Rajan Keshav Panandiker, West Chester, OH (US); Bernard William Kluesener, Harrison, OH (US); Chathurika R. K. Jayasundara, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/192,049

(22) Filed: Mar. 4, 2021

(65) Prior Publication Data

US 2021/0277327 A1 Sep. 9, 2021

Related U.S. Application Data

(60) Provisional application No. 62/985,958, filed on Mar. 6, 2020.

(51) Int. Cl.

| | |
|---|---|
| ***C11D 3/37*** | (2006.01) |
| ***C11B 9/00*** | (2006.01) |
| ***C11D 3/50*** | (2006.01) |

(52) U.S. Cl.

CPC ..... *C11B 9/0034* (2013.01); *C11D 3/505* (2013.01)

(58) Field of Classification Search

CPC . A61Q 5/02; A61Q 5/12; A61Q 19/10; A61Q 19/00; C11D 3/373; C11D 3/3742; C11D 3/50; C11D 17/0013; A61K 8/898; A61K 8/89

See application file for complete search history.

(56) References Cited

U.S. PATENT DOCUMENTS

| | | | | |
|---|---|---|---|---|
| 2006/0003913 | A1* | 1/2006 | Boutique | C11D 3/373 510/392 |
| 2009/0233836 | A1 | 9/2009 | Bodet et al. | |
| 2014/0102475 | A1* | 4/2014 | Martinez-Crowley | C11D 17/0017 510/347 |
| 2015/0313809 | A1* | 11/2015 | Lynch | A61Q 5/02 510/119 |

FOREIGN PATENT DOCUMENTS

| | | | |
|---|---|---|---|
| EP | 3031893 | A1 | 6/2016 |
| GB | 2499628 | A | 8/2013 |
| WO | 03033635 | A1 | 4/2003 |

OTHER PUBLICATIONS

PCT Search Report and Written Opinion for PCT/US2021/070230 dated Jun. 16, 2021, 10 pages.

All Office Actions; U.S. Appl. No. 17/946,082, filed Sep. 16, 2022.

U.S. Appl. No. 17/946,082, filed Sep. 16, 2022, to Rajan Keshav Panandiker et al.

* cited by examiner

*Primary Examiner* — John R Hardee

(74) *Attorney, Agent, or Firm* — Andrew J. Mueller; Gregory S. Darley-Emerson

(57) ABSTRACT

A fragrance premix composition that includes a silicone polymer, an aminofunctional material characterized by a molecular weight of less than about 1000 Daltons and having at least one primary or secondary amine moiety, and a fragrance material that includes one or more perfume raw materials having an aldehyde or ketone moiety, where the silicone, the aminofunctional material, and the fragrance material are reasonably miscible. Consumer products that include such fragrance premix compositions. Related methods of making and using such premixes and products.

14 Claims, No Drawings

FRAGRANCE PREMIX COMPOSITION COMPRISING A SILICONE POLYMER AND AMINOFUNCTIONAL MATERIAL

FIELD OF THE INVENTION

The present disclosure relates to fragrance premix compositions that include a silicone polymer, an aminofunctional material, and a fragrance material that includes aldehyde and/or ketone moieties, where the components are reasonably miscible. The present disclosure also relates to consumer product compositions that include such premixes. The present disclosure also relates to related methods of making and using such premixes and products.

BACKGROUND OF THE INVENTION

Manufacturers of consumer products, such as fabric care compositions, desire efficient ways to deliver perfume materials to their products, and perhaps more importantly to a consumer's target surface upon treatment with the consumer product. For example, if a consumer product is used to treat a fabric during a laundering operation, it is vastly preferred that the perfume materials deposit onto the fabric rather than be washed down the drain.

Perfume raw materials ("PRMs") can be co-mixed with silicones, and deposition efficiency may be improved; however, there is further room for improvement. Aminosilicones may be used in such mixtures with certain PRMs, and deposition efficiency may further increase due to interactions between the amine groups of the aminosilicone and the PRMs.

However, the loading capacity and/or number of interactions may be limited by the number of amino groups on the silicone. Furthermore, it is not necessarily a simple matter of increasing the amine content of the aminosilicone, as this would tend to increase solubility of the aminosilicone, thus reducing its tendency to be easily emulsified in water and/or deposit onto a fabric. Additionally, if the aminosilicone is too hydrophilic, it is believed that certain PRMs, many of which are relatively hydrophobic, will not partition into the silicone droplets and therefore will not be adequately associated with the silicone polymer, resulting in suboptimal perfume deposition upon usage.

Other amine-containing (non-silicone) compounds are known to be useful for perfume delivery purposes, but such compounds tend to lead to undesirable discoloration of perfume premixes and/or final products.

There is a need for improved fragrance premix compositions, related consumer product compositions, and/or related methods that addresses one or more of the above problems.

SUMMARY OF THE INVENTION

The present disclosure relates to fragrance premix compositions and related consumer products.

For example, the present disclosure relates to a fragrance premix composition that includes: a silicone polymer, where the silicone polymer is characterized by at least one of the following: (a) an Extraction Percentage (Extr. %) of less than less than 8, after 24 hours, and/or (b) a solubility in water of less than about 1000 mg/L, measured at 21° C., and/or (c) an amine content of from 0.0 to about 2.2; an aminofunctional material, where the aminofunctional material is characterized by a molecular weight of less than about 1000 Daltons, and where the aminofunctional material includes at least one amine moiety selected from a primary amine moiety, a secondary amine moiety, or a combination thereof; and a fragrance material that includes one or more perfume raw materials, where the one or more perfume raw materials comprises an aldehyde moiety, a ketone moiety, or combinations thereof; where a mixture of the silicone polymer, the aminofunctional material, and the one or more perfume materials is 20 reasonably miscible, for example when in a 9.9:0.1:0.1 weight ratio being characterized by a Percent Transmittance (% T) of at least 40 at 480 nm. The present disclosure further relates to methods of making such fragrance premix compositions.

The present disclosure also relates to consumer product compositions that include such fragrance premix compositions, consumer product compositions that contain droplets that include the components of the premix compositions, and methods of making and using such consumer product compositions.

DETAILED DESCRIPTION OF THE INVENTION

The present disclosure relates to fragrance premix compositions and related consumer products and methods. The fragrance premix compositions include a silicone polymer, an aminofunctional material, and a fragrance material that comprises certain perfume raw materials. Each of these materials is selected for certain characteristics and compatibilities, as described in more detail below. For example, the silicone polymer may be characterized by certain solubility in water, the aminofunctional material may have be characterized by a relatively low molecular weight, and the PRMs may comprise certain functional groups. Furthermore, the three components may be relatively miscible with each other. Failure to make the proper selections on one or more of the components may result in less efficient premixes or consumer products (e.g., as evidenced by decreased perfume performance).

Without being bound by theory, it is believed that by de-coupling the amine groups from the silicone polymer, at least in part, the loading efficiency of the PRMs in the droplets can be increased while maintaining the relative hydrophobicity of the silicone, thereby allowing an emulsion to be conveniently made and/or enabling deposition to more efficiently occur.

Additionally, it has been found that pairing the aminofunctional material with the silicone polymer can lead to improved color stability in the premixes and/or final products. Without wishing to be bound by theory, it is believed that at least some of the aminofunctional material may partition into the silicone droplets, and the amine groups may thereby be "protected" from discoloring side reactions.

The components, premixes, compositions, and methods are described in more detail below.

As used herein, the articles "a" and "an" when used in a claim, are understood to mean one or more of what is claimed or described. As used herein, the terms "include," "includes," and "including" are meant to be non-limiting. The compositions of the present disclosure can comprise, consist essentially of, or consist of, the components of the present disclosure.

The terms "substantially free of" or "substantially free from" may be used herein. This means that the indicated material is at the very minimum not deliberately added to the composition to form part of it, or, preferably, is not present at analytically detectable levels. It is meant to include compositions whereby the indicated material is present only as an impurity in one of the other materials deliberately included. The indicated material may be present, if at all, at a level of less than 1%, or less than 0.1%, or less than 0.01%, or even 0%, by weight of the composition.

As used herein the phrase "fabric care composition" includes compositions and formulations designed for treating fabric. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation.

As used herein, "fragrance premix composition," "premix composition," and "premix" are used interchangeably, unless otherwise indicated.

As used herein, "amine content," "amine value," and "amine content values" are used interchangeably unless indicated otherwise and can be determined according to the method provided in the Test Method section. Weight percent of nitrogen can be determined from the total amine value as provided in the Test Method Section.

Unless otherwise noted, all component or composition levels are in reference to the active portion of that component or composition, and are exclusive of impurities, for example, residual solvents or by-products, which may be present in commercially available sources of such components or compositions.

All temperatures herein are in degrees Celsius (° C.) unless otherwise indicated. Unless otherwise specified, all measurements herein are conducted at 20° C. and under the atmospheric pressure.

In all embodiments of the present disclosure, all percentages are by weight of the total composition, unless specifically stated otherwise. All ratios are weight ratios, unless specifically stated otherwise.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Fragrance Premix Compositions

The present disclosure relates to fragrance premix compositions. The fragrance premix compositions of the present disclosure may be useful components of consumer product compositions and may help to improve perfume delivery and performance of those consumer product compositions compared to products where such a premix is not used. Further, it is believed that combining the ingredients in a premix provide more efficient perfume delivery and performance in a consumer product compared to if the ingredients are added separately (e.g., not as a premix) to the consumer product, particularly in aqueous consumer products.

The fragrance premix compositions comprise a silicone polymer, an aminofunctional material, and a fragrance material, each of which is described in more detail below. The components should be selected based on a variety of characteristics. Failure to make the proper selections may lead to suboptimal premix compositions.

The silicone polymer, the aminofunctional material, and the fragrance material should be reasonably miscible with each other as a ternary system (silicone polymer, aminofunctional material, fragrance material). If the components are not reasonably miscible, then they may not associate with each other and/or may not form droplets that comprise all three components in an emulsion or in a consumer product composition. It is desirable that such droplets form to facilitate what is believed to be the most efficient perfume delivery system.

To determine whether the three selected components are reasonably miscible, they may be mixed together and visually inspected; if a mixture of 9.9 parts (by weight) silicone polymer, 0.1 part aminofunctional material, and 0.1 part fragrance material is mixed with a vortex mixer, water (if any) is removed, and then the mixture is visually inspected, the components may be considered miscible if the mixture appears transparent. Additionally or alternatively, to determine whether the three selected components are reasonably miscible, they may be mixed together and analyzed for percent transmittance. More specifically, a mixture of 9.9 parts (by weight) silicone polymer, 0.1 part aminofunctional material, and 0.1 part fragrance material may be provided, mixed with a vortex mixer, and then analyzed for percent transmittance (% T) at 480 nm. More details for such measurements are provided in the Test Methods section below. The % T of the ternary system at 480 nm may be at least 40, or at least 50, or at least 60, or at least 75, or at least 80, or at least 85, or at least 90, or at least 95, or at least 98. Greater values of % T correlate with greater transparency of the mixture, indicating greater degrees of miscibility.

The silicone polymer and the aminofunctional material may be reasonably miscible in the absence of the fragrance material. A mixture of 9.9 parts (by weight) silicone polymer and 0.1 part aminofunctional material (i.e., a binary system) may be provided, mixed with a vortex mixer, and then analyzed for percent transmittance (% T) at 480 nm according to the test method provided below. The % T of this binary system at 480 nm may be at least 40, or at least 50, or at least 60, or at least 75, or at least 80, or at least 85, or at least 90, or at least 95, or at least 98. Greater values of % T correlate with greater transparency of the mixture, indicating greater degrees of miscibility.

The fragrance premix composition is a liquid. The premix may be characterized by a viscosity, for example from about 10 to about 10000 Pa·s, preferably from about 10 to about 5000 Pa·s, preferably from about 10 to about 1000 Pa·s, preferably from about 10 to about 500 Pa·s, preferably from about 20 to about 400 Pa·s, more preferably from about 25 to about 300 Pa·s, even more preferably from about 100 to about 300 Pa·s, measured at 0.1 rad/s and 25° C. Obtaining a fragrance premix composition with the target viscosity may be desirable for processability reasons, particularly as premixes having a very high viscosity may be difficult to formulate into a product.

The fragrance premix composition may be substantially free of water. The premix composition may comprise less than 10%, or less than 5%, or less than 2%, or less than 1%, or less than 0.5%, or less than 0.1%, or even comprise 0%, by weight of the premix composition of water. Such low-water premixes may be desirable, for examples, when the premix will be formulated into a low-water consumer product, such as a solid composition or a composition encapsulated by water-soluble film. In such cases, the silicone polymer may be a fluid that is the bulk of the premix.

The fragrance premix composition may comprise water. The fragrance premix composition may comprise from about 1% to about 90%, or from about 1% to about 75%, or from about 1% to about 60%, or from about 1% to about 50%, or from about 5% to about 50%, or from about 10% to about 50%, or from about 25% to about 50%, by weight of the composition, of water. The presence of water may facilitate the formation of droplets, in view of the silicone polymer being relatively hydrophobic, which can facilitate more convenient dispersion of the premix in a consumer product.

The fragrance premix composition may be in the form of an emulsion. The emulsion may preferably be an oil-in-water emulsion. The emulsion may comprise a plurality of droplets, preferably where the plurality of droplets are characterized by a mean diameter of from about 1 micron to about 10 microns, preferably from about 1 micron to about 5 microns. Without wishing to be bound by theory, it is believed that droplets of a certain minimum size are desired for efficiency of deposition onto the target surface, but that droplets that exceed a certain size can create performance and/or stability issues, such spotting on the target surface.

The fragrance premix composition may comprise one or more emulsifiers. As used herein, "emulsifier(s)" and "emulsifying agent(s)" are used interchangeably. Selection of proper emulsifier can facilitate the formation of droplets of the desired size, and/or the stable incorporation of the premix into a final product. Emulsifiers may also be selected so as to not have an undesirable impact on viscosity of the emulsion, for example by increasing the viscosity to an undesirable level.

The one or more emulsifiers may comprise a nonionic surfactant. Suitable nonionic surfactant may include alkoxylated fatty alcohols. The nonionic surfactant may be selected from ethoxylated alcohols and ethoxylated alkyl phenols of the formula R(OC2H4),OH, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15.

The one or more emulsifiers may comprise linear emulsifiers, branched emulsifiers, or mixtures thereof, preferably linear nonionic surfactants, branched nonionic surfactants, or mixtures thereof. In particular, linear emulsifiers may be useful for emulsifying the fragrance materials, and branched emulsifiers may be useful for emulsifying the silicone polymer, particularly aminofunctional silicone polymers.

The one or more emulsifiers may be substantially hydrophobic. The one or more emulsifiers may be characterized by an HLB value of from about 5 to about 20, or from about 8 to about 16. The HLB value of a nonionic surfactant may be determined according to the method provided below.

The silicone polymer, the aminofunctional material, and the fragrance material are described in more detail below.

Silicone Polymer

The fragrance premix compositions of the present disclosure comprise a silicone polymer (or simply "silicone" as used herein). Without wishing to be bound by theory, it is believed that the hydrophobic nature of the silicone polymer facilitates effective deposition of the fragrance materials onto a target surface, such as a fabric during a laundering operation.

The fragrance premix composition may comprise from about 30% to about 98%, or from about 40% to about 95%, or from about 50% to about 90%, or from about 60% to about 85%, by weight of the fragrance premix composition, of the silicone polymer.

The silicone polymer may be relatively hydrophobic. Relatively hydrophobic silicones may be emulsified in water, in a premix, and/or in a consumer product composition and form droplets in the composition. This can enable partitioning of the aminofunctional material and the fragrance material into the droplet so that the components of the ternary system are associated with each other, resulting in efficient perfume deposition and performance in end use, as well as improved color stability. On the other hand, if the silicone is too hydrophilic or too soluble in water, it may not facilitate effective partitioning or perfume delivery.

The silicone polymer may have a relatively low solubility in water. The silicone polymer may be characterized by a solubility in water of less than about 1000 mg/L (e.g., less than about 1000 mg silicone solubilizing in 1 L of water), or less than about 750 mg/L, or less than about 500 mg/L, or less than about 250 mg/L, or less than about 150 mg/L, or less than about 100 mg/L, measured at 25° C.

The silicone polymer may be characterized by its Extraction Percentage ("Extr. %"). The Extraction Percentage of a silicone polymer relates to how much (typically reported as a weight %) of an initial polymer sample that is combined with DI water can be found in the water after a certain time period. Thus, relatively low Extr. % values indicate a relatively low degree of water solubility. As described above, it may be preferred that the silicone polymers of the present disclosure are characterized by relatively low water solubility, and so it follows that relatively low Extr. % values may also be preferred. For example, the silicone polymers of the present disclosure may be characterized by an Extr. % value of less than 8%, or less than 5%, or less than 4%, or less than 2%, or less than 1%, or less than 0.5%, or even less than 0.1%, after 24 hours. The silicone polymers of the present disclosure may be characterized by an Extr. % value of less than 15%, or less than 10%, or less than 5%, or less than 3%, or less than 2%, or less than 1.5%, after six days. Extraction Percentage is determined according to the method provided in the Test Methods section below.

The molecular weight of the silicone is usually indicated by the reference to the viscosity of the material. The silicones may comprise a viscosity of from about 10 to about 2,000,000 centistokes at 25° C. Suitable silicones may have a viscosity of from about 50 to about 200,000 centistokes, or from about 100 to about 100,000 centistokes, or from about 500 to about 60,000 centistokes, or from about 1000 to about 50,000 centistokes, or from about 1000 to about 10,000 centistokes, at 25° C. Relatively higher molecular weights and/or viscosities of the silicone may be preferred, as such silicones may be relatively hydrophobic.

It is preferred that the silicone polymer is be a fluid at room temperature (e.g., 22° C.) so that effective partitioning and droplet formation can conveniently occur.

Suitable silicones may be linear, branched, or cross-linked. The silicones may comprise silicone resins. Silicone resins are highly cross-linked polymeric siloxane systems. The cross-linking may be introduced through the incorporation of trifunctional and tetrafunctional silanes with monofunctional or difunctional silanes, or both, during manufacture of the silicone resin.

Suitable silicones may include non-functionalized siloxane polymers, functionalized siloxane polymers, or combinations thereof. The silicone may comprise a non-functionalized siloxane polymer. (By non-functionalized, it is meant that functional groups, if present, are generally non-reactive—for example, methyl groups.) The siloxane polymer may comprise polyalkyl and/or phenyl silicone fluids, resins, and/or gums.

The silicone polymer may comprise an aminosilicone, silicone polyether, polydimethylsiloxane (PDMS), cationic silicones, silicone polyurethane, silicone polyureas, or mixtures thereof. The silicone polymer may preferably be selected from a polydimethylsiloxane (PDMS) polymer, an aminosilicone, or a mixture thereof.

The silicone polymer may comprise a cyclic silicone. The cyclic silicone may comprise a cyclomethicone of the formula $[(CH_3)_2SiO]_n$ where n is an integer that may range from about 3 to about 7, preferably from about 5 to about 6.

The silicone polymer may include at least one methyl group on at least some silicone atoms, or at least two methyl groups on at least some silicone atoms. The silicone polymer may comprise

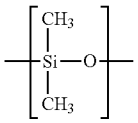

moieties; such polymers may further comprise additional functional moieties, such as aminofunctional moieties, or such polymers may be free of additional functional moieties. The silicone polymer may be a polydimethylsiloxane (PDMS).

The siloxane polymer may have an empirical structure according to Formula (I) below:

$$[R_1R_2R_3SiO_{1/2}]_n[R_4R_4SiO_{2/2}]_m[R_4SiO_{3/2}]_j \quad \text{Formula (I)}$$

wherein:

i) each $R_1$, $R_2$, $R_3$ and $R_4$ may be independently selected from the group consisting of H, —OH, $C_1$-$C_{20}$ alkyl moieties, $C_1$-$C_{20}$ substituted alkyl moieties, $C_6$-$C_{20}$ aryl moieties, $C_6$-$C_{20}$ substituted aryl moieties, alkylaryl moieties, and/or $C_1$-$C_{20}$ alkoxy moieties;

ii) n may be an integer from about 2 to about 10, or from about 2 to about 6; or 2; and selected that n=j+2;

iii) m may be an integer from about 5 to about 8,000, from about 7 to about 8,000 or from about 15 to about 4,000; and iv) j may be an integer from 0 to about 10, or from 0 to about 4, or 0.

In the silicone polymer according to Formula (I), the $R_2$, $R_3$ and $R_4$ groups may independently comprise methyl, ethyl, propyl, $C_4$-$C_{20}$ alkyl, and/or $C_6$-$C_{20}$ aryl moieties. Each of $R_2$, $R_3$ and $R_4$ may be methyl. Each $R_1$ moiety blocking the ends of the silicone chain may comprise a moiety selected from the group consisting of hydrogen, methyl, methoxy, ethoxy, hydroxy, propoxy and/or alkoxy.

Non-limiting examples of such silicones are polydimethylsiloxanes (used interchangeably herein with "polydimethylsilicone" or "PDMS" or "dimethicone"), such as Xiameter PMX 200 fluid available from Dow Chemicals (Midland Mich.), and/or silanol terminated silicones (also called dimethiconol) such as DMS-S31, DMS-S32 and DMS-S42, all available from Gelest Inc. (Morrisville, Pa.).

The silicone polymer may be a homopolymer or a copolymer comprising one or more of the following repeat units: diphenylsiloxane, phenylmethylsiloxane, alkylarylsiloxane, 2-phenylpropylmethyl siloxane, ethylmethylsiloxane, propylmethylsiloxane, butylmethylsiloxane, octylmethylsiloxane, dodecylmethylsiloxane, tetradecylmethylsiloxane, hexadecylmethylsiloxane, octadecylmethylsiloxane, or mixtures thereof.

Examples of such polymers are: PDM-1922, PDM-0821 PMM-1043, PMM-1025, PMM 0021, APT-133, APT-213, APT-263, ALT-143, Alt-281, DMA-021 (all available from Gelest Inc, Morrisville, Pa.), and/or Silwax 3H12-MS, Silwax3H-MS, and Silwax-L118 (all available from Siltech Corporation, Toronto, Canada).

The silicone may comprise a functionalized siloxane polymer. Functionalized siloxane polymers may comprise one or more functional moieties selected from the group consisting of amino, amido, alkoxy, hydroxy, carbinol, polyether, carboxy, hydride, mercapto, sulfate, phosphate, and/or quaternary ammonium moieties. These moieties nay be attached directly to the siloxane backbone through a bivalent alkylene radical (i.e., "pendant"), or may be part of the backbone. Suitable functionalized siloxane polymers include materials selected from the group consisting of aminosilicones, amidosilicones, silicone polyethers, silicone-urethane polymers, quaternary ABn silicones, amino ABn silicones, and combinations thereof.

The silicone polymer may comprise an aminosilicone (also disclosed herein as, and used interchangeably with, an "aminofunctional silicone"). Aminosilicones may be preferred, as such silicone polymers provide additional amine groups for further fragrance loading, thereby providing a more efficient fragrance delivery system. Suitable silicone polymers may preferably include amine groups but no other hydrophilic functional groups, such as carboxy or hydroxy groups, as such functional groups may undesirably increase the water solubility of the silicone polymers without offering suitable fragrance loading sites for aldehyde- or ketone-containing PRMs.

Suitable aminosilicones may have an empirical structure according to Formula (II):

$$[R_1R_2R_3SiO_{1/2}]_{(j+2)}[(R_4Si(X—Z)O_{2/2}]_k[R_4R_4SiO_{2/2}]_m [R_4SiO_{3/2}]_j \quad \text{Formula (II)},$$

wherein:

$R_1$, $R_2$, $R_3$ and $R_4$ are each independently selected from —H, —OH, $C_1$-$C_{20}$ alkyl, $C_1$-$C_{20}$ substituted alkyl, $C_6$-$C_{20}$ aryl, $C_6$-$C_{20}$ substituted aryl, alkylaryl, $C_1$-$C_{20}$ alkoxy and combinations thereof, with the proviso that $R_1$ may also be selected from X—Z in addition to the other groups mentioned;

X is a divalent alkylene radical comprising from 2 to 12 carbon atoms, and/or is independently selected from the group consisting of $—(CH_2)_s—$, $—CH_2—CH(OH)—CH_2—$,

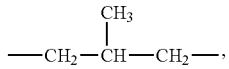

and mixtures thereof, wherein s is on average from about 2 to about 10;

Z is independently selected from the group consisting of

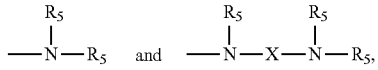

and mixtures thereof, wherein s is on average from about 2 to about 10;

Z is independently selected from the group consisting of wherein $R_5$ is selected from —H, $C_1$-$C_{20}$ alkyl, $C_1$-$C_{20}$ substituted alkyl, and combinations thereof, such that at least one $R_5$ on each nitrogen is a hydrogen atom;

k is on average from about 3 to about 40;

m is on average from about 100 to about 2,000; and j is on average from about 0 to about 10.

In a preferred silicone polymer according to Formula (II), $R_1$, $R_2$, $R_3$ and $R_4$ are all —$CH_3$ groups, and j=0.

It may be preferred that the silicone polymer comprises silicones according to the following structures:

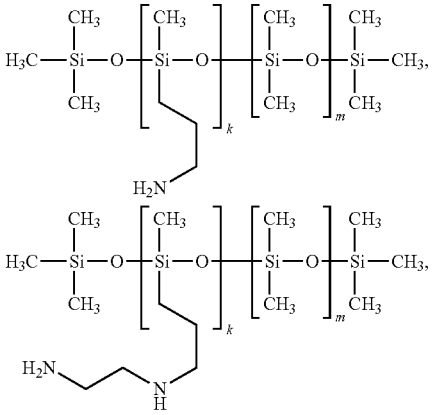

or mixtures thereof, where k and m are defined as above with regard to Formula (II). Such silicone polymers are believed to be particularly useful in the fragrance premixes of the present disclosure.

The aminofunctional silicone may be characterized by one or more amine content values. The amine content, namely the primary, secondary, tertiary, and/or total amine values (meq/g), is defined as the milliequivalents of amine functionality (primary, secondary, tertiary, and/or total) present in one gram of a sample. Without wishing to be bound by theory, it is believed that the amine content of the amino functional silicone contributes, at least in part, to the solubility in water of the amino functional silicone. For example, as amine content increases, the amino functional silicone is generally more soluble in water. Therefore, it may be desirable to limit the nitrogen content of the amino functional silicone in order to maintain a relatively low solubility, thereby facilitating portioning of the perfume materials out of the aqueous phase of the emulsion.

The amino functional silicone may be characterized by a total amine content of from about 0.05 to about 2.2, preferably from about 0.1 to about 2.14, or from about 0.071 to about 1.78, or from about 0.71 to about 1.43, or from about 0.14 to about 1.07, or from about 0.14 to about 0.71, or from about 0.21 to about 0.71, or from about 0.36 to about 0.71. The amino functional silicone may be characterized by a primary amine content of from about 0.05 to about 2.2, preferably from about 0.071 to about 2.14, or from about 0.071 to about 1.78, or from about 0.71 to about 1.43, or from about 0.14 to about 1.07, or from about 0.14 to about 0.71, or from about 0.21 to about 0.71, or from about 0.36 to about 0.71. The amino functional silicone may characterized by a ratio of primary amine content to total amine content of from about 1:2 (e.g., 50%) to about 2:2 (e.g., 100%), or from about 1.2:2, or from about 1.5:2, or from about 1.8:2. It may be preferred to select an amino functional silicone having a relatively high proportion of primary amines compared to total amines to improve the PRM loading efficiency, given that on fabric it is believed that the PRM residues be associated with, or may even have reacted with, primary amines.

The amino functional silicone may be characterized by a weight percentage of nitrogen. For example, the amino functional silicone may be characterized by a nitrogen content of from about 0.1% to about 4%, or from about 0.1% to about 3%, or from about 0.1% to about 2%, or from about 0.2% to about 1.5%, or from about 0.2% to about 1.0%, or from about 0.3% to about 0.8%, or from about 0.3% to about 0.75%, reported as functional group equivalent weight %. The functional group equivalent weight percentage can be determined from the amine values of the amino functional silicone, as described in more detail in the Test Methods section. The silicone polymer may be free of nitrogens, in which case its nitrogen content may be 0.0%; therefore, suitable silicones may be characterized by a nitrogen content of from 0.0% to about 4%.

Exemplary commercially available aminosilicones include: Xiameter 8566, Xiameter 8822, available from Dow Performance Silicones; KF-873, KF-861, KF-867, KF-8003, available from Shin-Etsu Silicones of North America, Akron, Ohio; and Magnasoft Plus and SF-1708, available from Momentive Performance Materials, Tarrytown, N.Y.

Aminofunctional Material

The fragrance premix compositions of the present disclosure comprise an aminofunctional material. It is believed that the aminofunctional material associates with the perfume raw materials described herein and facilitate the deposition and release of the perfume when used, for example in a consumer product. Furthermore, it is believed that when the aminofunctional material can adequately associate with the silicone polymer, deposition and color stability benefits can further be achieved.

The fragrance premix composition may comprise from about 1% to about 20%, or from about 2% to about 15%, or from about 3% to about 12%, or from about 4% to about 10%, or from about 5% to about 10%, by weight of the fragrance premix composition, of the aminofunctional material.

The amino functional material may be characterized by a relatively low molecular weight. Relatively low molecular weights may be preferred for mass efficiency reasons (e.g. a favorable/high ratio of amine groups to molecular weight). For example, the aminofunctional material may be characterized by a molecular weight of about 40 to about 1000 Daltons, preferably from about 50 to 800 Daltons, more preferably from about 60 to about 600 Daltons, even more preferably from about 60 to about 500 Daltons.

The aminofunctional material may comprise one, two, or three amine moieties per molecule, preferably one or two amine moieties. The amine moiety may be selected from the group consisting of a primary amine moiety, a secondary amine moiety, or a combination thereof. It is believed that primary and/or secondary amine moieties may better associate with the PRMs compared to tertiary and/or quaternary amine moieties. Furthermore, two or even three amine moieties may provide improved association/loading in combination with the perfume raw materials, compared to compounds having only one amine group. However, as described in more detail below, there may be a desire to limit the number of amine groups.

In general, the greater the number of amine moieties, the greater the solubility of the compound in water. It is believed that if the material is too water-soluble/hydrophilic, it may not be adequately miscible with the silicone, which is generally hydrophobic. One way to quantify the amine content of the molecule is the Amine Equivalent Weight of the molecule. For the sake of the present disclosure, the Amine Equivalent Weight is defined as the molecular weight of aminofunctional material divided by the sum of the number of primary amine groups and the number of secondary amine groups per molecule. This is represented below as an equation:

$$\text{Amine Equivalent Weight} = \frac{\text{Molecular Weight of } \textit{Aminofunctional} \text{ Material}}{\left(\begin{array}{l}\text{Number of Primary Amine Groups} + \\ \text{Number of Secondary Amine Groups}\end{array}\right)}$$

The aminofunctional material may have an Amine Equivalent Weight of about 25 to 300, preferably from about 50 to about 180, more preferably from about 60 to about 130 g/mol.

The aminofunctional material may be substantially free of any hydrophilic moieties other than primary and/or secondary amines, as such hydrophilic moieties tend to increase the water-solubility of the material. Such hydrophilic moieties may include tertiary amine groups, hydroxyl groups (preferably hydroxyl groups that are not separated by two carbon atoms from a primary or secondary amine group), polyether groups, and carboxyl groups or salts thereof. Preferably, the material comprises no (zero) hydrophilic moieties, other than primary or secondary amines. If the material does contain hydrophilic moieties other than primary or second amines, then it is preferred that the Hydrophilic Group Equivalent Weight of the aminofunctional material is greater than 100. As used in the present disclosure, the Hydrophilic Group Equivalent Weight is defined as molecular weight of the aminofunctional material divided by the number of hydrophilic groups in a molecule of the aminofunctional material, not including primary and secondary amines. This is represented below as an equation:

$$\text{Hydrophilic Group Equivalent Weight} = \frac{\text{Molecular Weight of Amino Functional Material}}{\text{Number of Hydrophilic Groups}}$$

It is believed that certain aminofunctional materials are likely to work better than others in the compositions of the present disclosure due to their amine moiety type and/or structure. For example, the aminofunctional material may be characterized by one of the following: (a) comprising a total of one primary amine moiety and no secondary amine moieties; or (b) comprising a total of two primary amine moieties and no secondary amine moieties; or (c) one primary amine moiety and one secondary amine moiety, preferably where the primary amine moiety and the secondary amine moiety are separated by two carbon atoms; or (d) one primary amine moiety or secondary amine moiety that is separated by two carbon atoms from a hydroxyl group.

The aminofunctional material may be selected from the group consisting of: (a) an aliphatic aminofunctional material, which may be linear or branched, preferably branched; (b) a cycloaliphatic aminofunctional material; (c) an aminofunctional silane; (d) an aminoalcohol where one primary amine moiety or secondary amine moiety is separated by two carbon atoms from a hydroxyl group; or (e) mixtures thereof. The aminofunctional material may be substantially free of aromatic amines (e.g., where an aminofunctional moiety is directly attached to an aromatic ring), or even substantially free of aromatic moieties altogether, as such moieties tend to increase the solubility of the aminofunctional material and therefore may make it less likely to associate with the hydrophobic silicone.

The aminofunctional material may comprise aliphatic aminofunctional material that is linear. Suitable linear aliphatic aminofunctional materials may include octylamine, nonylamine, decylamine, or mixtures thereof. For such materials, it is believed that monoamines are preferred, as diamines tend to be solid at room temperature and more difficult to process.

Suitable aliphatic aminofunctional materials may preferably be branched. Such materials may include: 2-ethylhexylamine; tridecylamine, branched; t-butylamine; neopentanediamine (2,2-dimethyl propane-1,3-diamine); trimethyl-1,6-hexanediamine; 2-aminoheptane; 2-butyloctylamine; or mixtures thereof.

Suitable cycloaliphatic amines preferably have a structure according to Formula (III):

Formula (III)

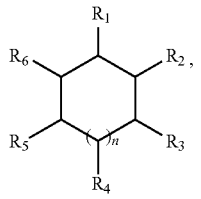

where the substituents $R_1$, $R_2$, $R_3$, $R_4$, $R_5$ and $R_6$ are independently selected from —$NH_2$, —H, hydrophilic groups, alkyl groups, alkenyl groups, substituted alkyl groups, cycloaliphatic groups having from 1 to 10 carbon atoms, or substituted cycloaliphatic groups having from 1 to 10 carbon atoms; n is from 0 to 3, preferably n is 1; with the proviso that the compound according to Formula (III) has from 1 to 3 primary and/or secondary amine groups, preferably from 1 to 3 primary amine groups, more preferably 2 primary amine groups. It may be preferred that the cycloaliphatic aminofunctional material also meets the criteria set forth above with regard to the Amine Equivalent Weight and/or the Hydrophilic Group Equivalent Weight, preferably both.

The alkyl, alkenyl, and/or substituted alkyl groups of Formula (III), if any, may independently be linear or branched. Substituted alkyl and substituted cycloaliphatic groups of Formula (III), if any, can be substituted with primary and/or secondary amine groups.

Suitable cycloaliphatic amines may include the following materials, or mixtures thereof:

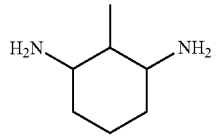

2-methylcyclohexane-1,3-diamine

-continued

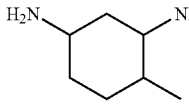

4-methylcyclohexane-1,3-diamine

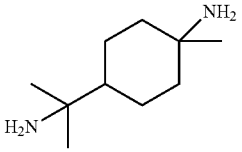

4-(2-aminopropan-2-yl)-1-methylcyclohexan-1-amine

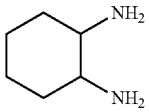

cyclohexane-1,2-diamine

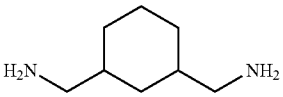

cyclohexane-1,3-diyldimethanamine

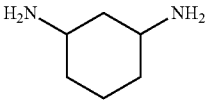

cyclohexane-1,3-diamine

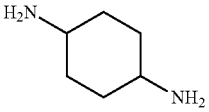

cyclohexane-1,4-diamine

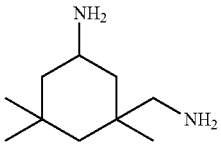

3-(aminomethyl)-3,5,5-trimethylcyclohexan-1-amine

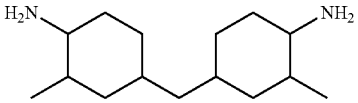

4,4′-methylenebis(2-methylcyclohexan-1-amine)

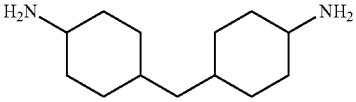

4,4′-methylenebis(cyclohexan-1-amine)

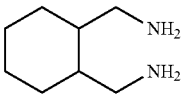

cyclohexane-1,2-diyldimethanamine

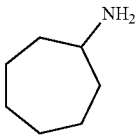

cycloheptanamine

-continued

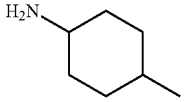

4-methylcyclohexan-1-amine

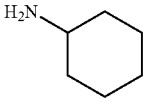

cyclohexanamine

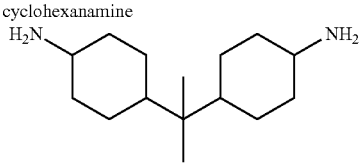

4, 4′-(propane-2, 2-diyl)bis(cyclohexan-1-amine)

Particularly preferred cycloaliphatic amines may include methylcyclohexane diamines, preferably: 2-methylcyclohexane-1,3-diamine; 4-methylcyclohexane-1,3-diamine; or mixtures thereof.

The aminofunctional material may comprise an aminofunctional silane. Suitable aminofunctional silanes may include trialkoxy(aminoethylaminopropyl)silane, alkyl dialkoxy(aminoethylaminopropyl)silane, dialkyl alkoxy (aminoethylaminopropyl)silane, trialkoxy(aminopropyl)silane, alkyl dialkoxy(aminopropyl)silane, dialkyl alkoxy (aminopropyl)silane, or mixtures thereof. Preferred aminofunctional silanes may include trimethoxy(aminoethylaminopropyl)silane, triethoxy(aminoethylaminopropyl)silane, methyl dimethoxy(aminoethylaminopropyl)silane, ethyl dimethoxy(aminoethylaminopropyl)silane, dimethyl methoxy(aminoethylaminopropyl)silane, dimethyl ethoxy (aminoethylaminopropyl)silane, trimethoxy(aminopropyl) silane, triethoxy(aminopropyl)silane, methyl dimethoxy (aminopropyl)silane, ethyl dimethoxy(aminopropyl)silane, dimethyl methoxy(aminopropyl)silane, dimethyl ethoxy (aminopropyl)silane, or mixtures thereof.

The aminofunctional material may comprise an aminoalcohol, preferably where one primary amine moiety or one secondary amine moiety is separated by two carbon atoms from a hydroxyl group. Although aminofunctional materials having hydrophilic groups such as hydroxyl groups are typically not preferred for use in the presently disclosed compositions, aminoalcohols having this particular configuration can be useful. Preferred aminoalcohols may include 2-(butylamino)ethanol, 1-(cyclohexylamino)2-propanol, 1-(dodecyloxy)-3-[(2-hydroxyethyl)amino]-2-propanol, 3-(dodecylamino)-1,2-propanediol, or mixtures thereof.

Another suitable aminofunctional material is 1,3-bis(3-aminopropyl) tetramethyldisiloxane.

Fragrance Material

The fragrance premix composition comprises fragrance material. Such materials are desirably formulated in final products to provide a pleasant aroma upon usage, and/or to cover up undesirable smells.

The fragrance material may comprise one or more perfume raw materials ("PRMs"). One or more of the perfume raw materials may comprise an aldehyde moiety, a ketone moiety, or combinations thereof. Without wishing to be bound by theory, it is believed that PRMs with aldehyde or ketone moieties can interact with the amine moieties of the aminofunctional material (and the aminosilicone polymer, if present) described herein in a way that results in improved perfume deposition and/or performance in a consumer product. Furthermore, it is believed that PRMs having certain structures are more likely to perform better than others.

In general, the term "perfume raw material" (or "PRM") as used herein refers to compounds having a molecular weight of at least about 100 g/mol and which are useful in imparting an odor, fragrance, essence, or scent, either alone or with other perfume raw materials. Typical PRMs comprise inter alia alcohols, ketones, aldehydes, esters, ethers, nitrites, and alkenes, such as terpene. A listing of common PRMs can be found in various reference sources, for example, "Perfume and Flavor Chemicals", Vols. I and II; Steffen Arctander Allured Pub. Co. (1994) and "Perfumes: Art, Science and Technology", Miller, P. M. and Lamparsky, D., Blackie Academic and Professional (1994).

The PRMs may be characterized by their boiling points (B.P.) measured at the normal pressure (760 mm Hg), and their octanol/water partitioning coefficient (P), which may be described in terms of log P, determined according to the test method below. A perfume having a variety of PRMs characterized by different boiling points and/or log Ps may be desirable, for example, to provide fragrance benefits at different touchpoints during normal usage.

As mentioned above, one or more of the perfume raw materials may comprise an aldehyde moiety, a ketone moiety, or combinations thereof. The one or more perfume raw materials may comprise an aldehyde moiety. The one or more perfume raw materials may comprise a ketone moiety.

The one or more perfume raw materials may be characterized by the following structure:

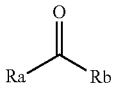

wherein Ra is selected from the group consisting of: $C_3$-$C_{18}$ alkyl, $C_3$-$C_{18}$ alkenyl, $C_3$-$C_{18}$ substituted alkyl,

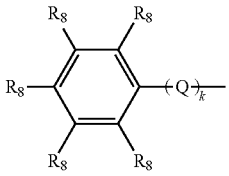

, and

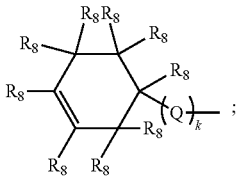

;

wherein each $R_8$ is independently selected from the group consisting of H, straight or branched chain $C_1$-$C_8$ alkyl, $C_1$-$C_8$ substituted alkyl, and $C_1$-$C_2$ alkoxy; k is an integer with value 0 or 1; Q is an alkylene radical with from 2 to 8 carbon atoms; and wherein Rb is selected from H and CH═CH—$R_9$, wherein $R_9$ is selected from H or a $C_1$-$C_3$ alkyl group. When Rb is H, the structure comprises an aldehyde moiety.

The Ra group may be selected from the group consisting of:

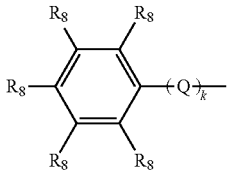

and

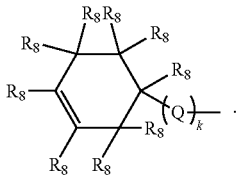

.

At least two $R_8$ groups may be fused to form a bicyclic structure, preferably a bicyclic structure selected from the group consisting of:

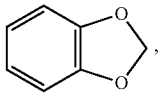

,

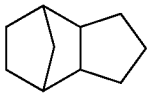

and

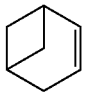

.

Each Q may be independently selected from

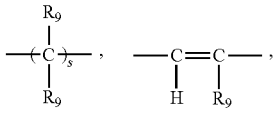

,

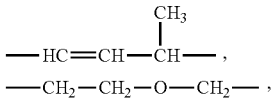

, and

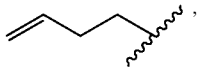

, wherein s is an integer from 1 to 4, wherein each $R_9$ is independently selected from H or $C_1$-$C_3$ alkyl group, and where ∿ (which may also be shown as an asterix, i.e. "*") represents the end of the moiety linked to the Ra group. Preferably, each Q is independently selected from

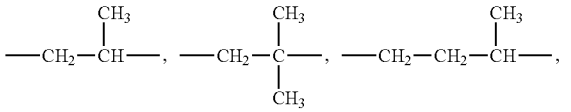

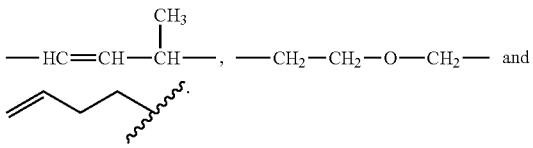

and

.

The Rb group may be H; in such cases, the perfume raw material typically comprises an aldehyde moiety.

The Rb group may be —CH═CH—$R_9$, wherein $R_9$ is selected from H or a $C_1$-$C_3$ alkyl group; in such cases, the perfume raw material typically comprises a ketone moiety.

The one or more perfume raw materials may be characterized by the following structure:

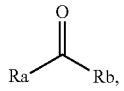

wherein Ra and Rb are selected from one of the following combinations:

a. Ra is selected from the group consisting of: $C_3$-$C_{18}$ alkyl, $C_3$-$C_{18}$ alkenyl, and $C_3$-$C_{18}$ substituted alkyl; and Rb is H;

b. Ra is selected from

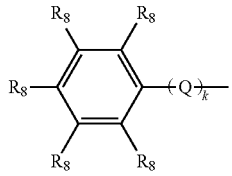

and

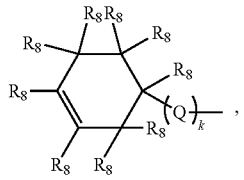

wherein k is 0, wherein $R_8$ is selected from the group consisting of H, $C_1$-$C_3$ alkyl, and $C_1$-$C_2$ alkoxy; and Rb is 0;

c. Ra is selected from the group consisting of:

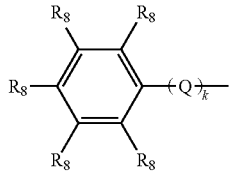

and

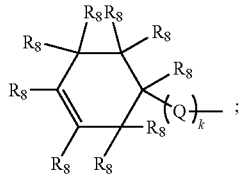

k is 1; $R_8$ is selected from the group consisting of H, $C_1$-$C_3$ alkyl, and $C_1$-$C_2$ alkoxy; Q is selected from the group consisting of:

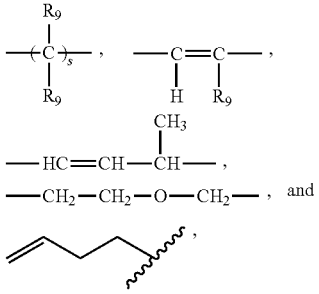

wherein s is an integer from 1 to 4, wherein each $R_9$ is independently selected from H or $C_1$-$C_3$ alkyl group, preferably wherein Q is selected from from

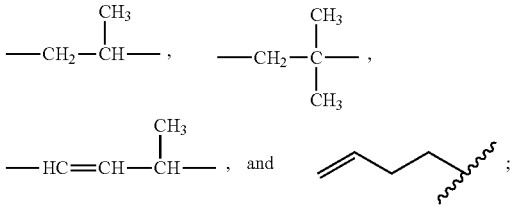

and Rb is H;

d. Ra is selected from the group consisting of:

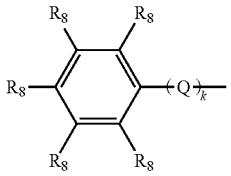

and

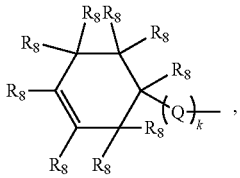

wherein k is 0, and Rb is —CH═CH—$R_9$, wherein each $R_9$ is independently selected from H or $C_1$-$C_3$ alkyl group; or e. mixtures thereof.

The one or more perfume raw materials may comprise structures (which may be substituted) selected from the following:

a.

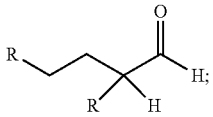

b.

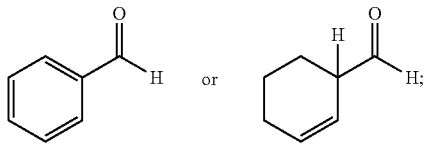

c.

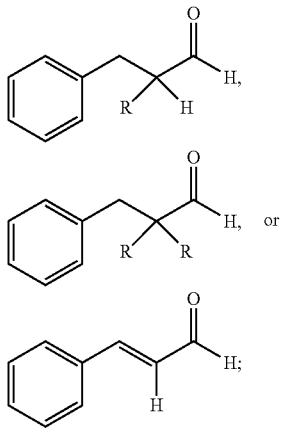

d.

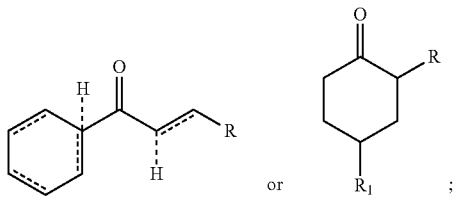

or e. mixtures thereof, where each R and/or $R_1$ is independently a suitable substituent moiety of the PRM, for example selected from the group $C_3$-$C_{18}$ alkyl, $C_3$-$C_{18}$ alkenyl, and $C_3$-$C_{18}$ substituted alkyl; or selected from the group H, $C_1$-$C_3$ alkyl, and $C_1$-$C_2$ alkoxy. To note, the structures of a.-d. are selections of the PRMs described in groups a.-d. above.

The one or more perfume raw materials may be selected from the following:

a. oncidal, methyl nonyl acetaldehyde, adoxal, melanal, calypsone, or mixtures thereof;

b. cuminic aldehyde, benzaldehyde, anisic aldehyde, heliotropin, isocyclocitral, triplal/ligustral, 3,6-ivy carbaldehyde, ligustral, scentenal, or mixtures thereof;

c. satinaldehyde (jasmorange), otropal, cyclamen homoaldehyde, cyclamen aldehyde (cyclamal), lilial, canthoxal, floralozone, cinnemic aldehyde, or mixtures thereof;

d. delta-damascone, beta-damascone, alpha-damascone, nectaryl, or mixtures thereof;

e. vanillin; ethyl vanillin; octahydro-4,7-methano-1H-indene-5-acetaldehyde; 3-[4-(2-methylpropyl)cyclohexyl]propanal; or mixtures thereof; or f. a combination of materials selected from at least two categories selected from categories a, b, c, d, and e.

To note, the specifically named perfume raw materials of groups a.-d. are selections of the structures provided in groups a.-d. in each of the previous sections above.

Perfume raw materials having these identities and/or structures (e.g., those described in groups a.-d.) have been found to perform surprisingly well in compositions according to present disclosure, as evidenced by relatively high headspace measurements on treated fabric, compared to other PRM structures. Furthermore, it is believed that vanillin and/or ethyl vanillin (described in group e. of the last list above) also perform substantially well in the methods and compositions of the present disclosure, even though such performance may not be substantially indicated by the present headspace analysis method.

The fragrance premix composition may comprise from about 1% to about 50%, or from about 5% to about 50%, or from about 10% to about 40%, or from about 15% to about 30%, or from about 15% to about 25%, by weight of the fragrance premix composition, of the one or more perfume raw materials.

As describe above, it is believed that the aldehyde and/or ketone moieties of the one or more perfume raw materials associates with the amine moieties of the aminofunctional material, and potentially with the amine moieties of the aminosilicone polymer, if present. Therefore, it may be desirable to provide the components at levels where the ketone/aldehyde moieties and the amine moieties are in molar amounts that are reasonably close to each other. For example, if the total moles of primary and secondary amine moieties present in the composition as provided by an aminosilicone polymer (if any) and the aminofunctional material is "X", and if the total moles of aldehyde moieties and/or ketone moieties (preferably aldehyde moieties) present in the composition as provided by the one or more perfume raw materials is "Y", then the ratio of X:Y may be from about 2:1 to about 1:10, preferably from about 2:1 to about 1:5, more preferably from about 2:1 to about 1:2, more preferably from about 1.5:1 to about 1:1.5, more preferably from about 1:1 to about 1:1.5. In general, it may preferred to have an excess of the perfume raw materials in question (e.g., X:Y is 1:1 or greater), to ensure that the amine moieties are loaded or quenched as much as possible, thereby facilitating improved perfume delivery and/or performance.

Processes of Making Premixes

The fragrance premix composition may be made according to any suitable process. For example, the present disclosure relates to a process of making a fragrance premix composition, such as those described herein, where the process includes the steps (preferably in order) of: providing the silicone polymer; adding the aminofunctional material; and adding the fragrance material; where each is provided in the relative amounts described above. Mixing may be provided throughout or intermittently. The resulting mixture may be mixed with sufficient mixing energy to combine the materials.

When it is desired that the fragrance premix composition is in the form of an emulsion, the process may include the steps (preferably in order) of: providing the silicone polymer; adding the aminofunctional material; adding an emulsifying agent; adding the water; and adding the fragrance material; where each is provided in the relative amounts described above. Mixing may be provided throughout or intermittently. The resulting mixture may be mixed with sufficient mixing energy to combine and emulsify the materials, for example to form the droplets described above.

The process may include the steps (preferably in order) of: providing the silicone polymer; adding an emulsifying agent; adding the water; adding the aminofunctional material; and adding the fragrance material; where each is provided in the relative amounts described above. Mixing may be provided throughout or intermittently. The resulting mixture may be mixed with sufficient mixing energy to combine and emulsify the materials, for example to form the droplets described above.

Certain components may be premixed, for example, the silicone polymer and an emulsifying agent, and/or the fragrance material and an emulsifying agent. The emulsifying agents for each material may be the same, or they may be different.

Consumer Products

The present disclosure also relates to consumer product compositions, as well as methods of making and using such consumer product compositions. The consumer product compositions may be useful for treating a surface, for example to freshen and/or condition the surface, such as fabric, hair, or skin. The consumer product compositions may comprise a fragrance premix composition, for example in emulsion form, according to the present disclosure and a consumer product adjunct. The consumer product compositions may be made by providing a fragrance premix composition according to the present disclosure, and combining the premix with a consumer product adjunct. The consumer product adjunct may be part of a base composition.

The consumer product compositions described herein may comprise from about 0.1% to about 20%, or from about 0.1% to about 15%, or from about 0.1% to about 10%, or from about 0.1% to about 5%, or from about 0.1% to about 3%, by weight of the consumer product composition, of a fragrance premix composition according to the present disclosure.

The consumer product compositions may comprise one or more of the following components at one or more of the following levels, where the component(s) is provided by the fragrance premix, and where the weight percentages are by weight of the consumer product composition: from about 0.1% to about 20% of the silicone polymer, and/or from about 0.05% to about 10% of the aminofunctional material, and/or from about 0.05% to about 20% of one or more perfume raw materials.

The present disclosure also relates to a consumer product composition that comprises a consumer product adjunct and a plurality of droplets, wherein the droplets comprise: a silicone polymer as described above; an aminofunctional material as described above; and a fragrance material as described above; where the components are present in the droplet in the relative amounts as described above, and where the components are suitably miscible as described above.

The droplets may be present in the consumer product composition as a result of combining a fragrance premix composition as described herein with a consumer product adjunct. The plurality of droplets may be characterized as having a mean diameter of from about 1 micron to about 10 microns, preferably from about 1 micron to about 5 microns.

For example, the present disclosure relates to a consumer product comprising a consumer product adjunct and a plurality of droplets, the droplets comprising: a silicone polymer, preferably wherein the silicone polymer is characterized by a solubility in water of less than about 1000 mg/L, measured at 25° C.; an aminofunctional material, preferably wherein the aminofunctional material is characterized by a molecular weight of less than about 1000 Daltons, and wherein the aminofunctional material comprises at least one amine moiety selected from a primary amine moiety, a secondary amine moiety, or a combination thereof; and one or more perfume raw materials, wherein the one or more perfume raw materials comprises an aldehyde moiety, a ketone moiety, or combinations thereof; preferably wherein a mixture of the silicone polymer, the aminofunctional material, and the one or more perfume materials in a 9.9:0.1:0.1 weight ratio is characterized by a % Transmittance (% T) of at least 40 at 480 nm. The droplets may comprise the materials in substantially the same proportions as described with respect to the fragrance premix composition.

The consumer product compositions according to the present disclosure may be in the form of a liquid composition, a granular composition, a single-compartment pouch, a multi-compartment pouch, a dissolvable sheet, a pastille or bead, a fibrous article, a tablet, a bar, a flake, a non-woven sheet, or a mixture thereof.

The consumer product compositions of the present disclosure may be a household care composition, preferably a household care composition selected from the group consisting of a fabric and home care product, a beauty care product, or a mixture thereof.

When the consumer product composition is a fabric and home care product, the fabric and home care product may preferably be selected from a laundry detergent composition, a fabric conditioning composition, a fabric pre-treatment composition, a fabric refresher composition, or a mixture thereof. The fabric conditioning composition may preferably be a liquid fabric conditioning composition.

When the consumer product composition is a beauty care product, the beauty care product may preferably be selected from a hair treatment product, a skin care product, a shave care product, a personal cleansing product, a deodorant and/or antiperspirant, or a mixture thereof. The hair treatment product preferably may preferably be a shampoo, a conditioner, or a combination thereof.

The consumer product composition may include a consumer product adjunct, in addition to the fragrance premix composition and/or droplets. The consumer product adjunct may be any adjunct ingredient, in any amount, that is suitable for the intended product and/or intended end-use of the product. The consumer product composition may be made by a method that comprises the step of combining the fragrance premix composition with the consumer product adjunct.

The consumer product adjunct may be part of a base composition that is combined with the fragrance premix composition. For example, the present disclosure relates to a method of making a consumer product that includes the step of combining a fragrance premix composition with a base composition, where the base composition comprises a consumer product adjunct.

The fragrance premix composition may be added to the base composition. Consumer product adjuncts may be added to the base composition before and/or after the fragrance premix composition is added to the base composition.

Consumer product adjuncts may be useful as performance aids, stability or processing aids, or both. For example, the consumer product adjunct may be selected from an amine, a surfactant system, a water-binding agent, a sulfite, fatty acids and/or salts thereof, enzymes, encapsulated benefit agents, soil release polymers, hueing agents, builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, polymeric dispersing agents, polymeric grease cleaning agents, brighteners, suds suppressors, dyes, hueing agents, free perfume, structure elasticizing agents, conditioning or softening agents, carriers, fillers, hydrotropes, organic solvents, antimicrobial agents and/or preservatives, neutralizers and/or pH adjusting agents, processing aids, fillers, rheology modifiers or structurants, opacifiers, pearlescent agents, pigments, anti-corrosion and/or anti-tarnishing agents, and mixtures thereof. While one of ordinary skill will generally be familiar with these adjuncts, a few of the adjuncts are described in more detail below.

The consumer product compositions may include surfactant. Surfactants may be useful for providing, for example, cleaning benefits. The compositions may comprise a surfactant system, which may contain one or more surfactants.

The compositions of the present disclosure may include from about 1% to about 70%, or from about 2% to about 60%, or from about 5% to about 50%, by weight of the composition, of a surfactant system. Liquid compositions may include from about 5% to about 40%, by weight of the composition, of a surfactant system. Compact formulations, including compact liquids, gels, and/or compositions suitable for a unit dose form, may include from about 25% to about 70%, or from about 30% to about 50%, by weight of the composition, of a surfactant system.

The surfactant system may include anionic surfactant, nonionic surfactant, zwitterionic surfactant, cationic surfactant, amphoteric surfactant, or combinations thereof. The surfactant system may include linear alkyl benzene sulfonate, alkyl ethoxylated sulfate, alkyl sulfate, nonionic surfactant such as ethoxylated alcohol, amine oxide, or mixtures thereof. The surfactants may be, at least in part, derived from natural sources, such as natural feedstock alcohols.

Suitable anionic surfactants may include any conventional anionic surfactant. This may include a sulfate detersive surfactant, for e.g., alkoxylated and/or non-alkoxylated alkyl sulfate materials, and/or sulfonic detersive surfactants, e.g., alkyl benzene sulfonates. The anionic surfactants may be linear, branched, or combinations thereof. Preferred surfactants include linear alkyl benzene sulfonate (LAS), alkyl ethoxylated sulfate (AES), alkyl sulfates (AS), or mixtures thereof. Other suitable anionic surfactants include branched modified alkyl benzene sulfonates (MLAS), methyl ester sulfonates (MES), sodium lauryl sulfate (SLS), sodium lauryl ether sulfate (SLES), and/or alkyl ethoxylated carboxylates (AEC). The anionic surfactants may be present in acid form, salt form, or mixtures thereof. The anionic surfactants may be neutralized, in part or in whole, for example, by an alkali metal (e.g., sodium) or an amine (e.g., monoethanolamine).

The surfactant system may include nonionic surfactant. Suitable nonionic surfactants include alkoxylated fatty alcohols, such as ethoxylated fatty alcohols. Other suitable nonionic surfactants include alkoxylated alkyl phenols, alkyl phenol condensates, mid-chain branched alcohols, mid-chain branched alkyl alkoxylates, alkylpolysaccharides (e.g., alkylpolyglycosides), polyhydroxy fatty acid amides, ether capped poly(oxyalkylated) alcohol surfactants, and mixtures thereof. The alkoxylate units may be ethyleneoxy units, propyleneoxy units, or mixtures thereof. The nonionic surfactants may be linear, branched (e.g., mid-chain branched), or a combination thereof. Specific nonionic surfactants may include alcohols having an average of from about 12 to about 16 carbons, and an average of from about 3 to about 9 ethoxy groups, such as $C_{12}$-$C_{14}$ E07 nonionic surfactant.

Suitable zwitterionic surfactants may include any conventional zwitterionic surfactant, such as betaines, including alkyl dimethyl betaine and cocodimethyl amidopropyl betaine, $C_8$ to $C_{18}$ (for example from $C_{12}$ to $C_{18}$) amine oxides (e.g., $C_{12-14}$ dimethyl amine oxide), and/or sulfo and hydroxy betaines, such as N-alkyl-N,N-dimethylammino-1-propane sulfonate where the alkyl group can be $C_8$ to $C_{18}$, or from $C_{10}$ to $C_{14}$. The zwitterionic surfactant may include amine oxide.

Depending on the formulation and/or the intended end-use, the composition may be substantially free of certain surfactants. For example, liquid fabric enhancer compositions, such as fabric softeners, may be substantially free of anionic surfactant, as such surfactants may negatively interact with cationic ingredients.

The consumer product compositions may include conditioning actives. Compositions that contain conditioning actives may provide softness, anti-wrinkle, anti-static, conditioning, anti-stretch, color, and/or appearance benefits.

Conditioning actives may be present at a level of from about 1% to about 99%, or from about 1% to about 35%, or from about 1% to about 20%, or from about 1% to about 15%, or from about 1% to about 10%, or from about 1% to about 6%, by weight of the composition. The composition may include from about 1%, or from about 2%, or from about 3%, to about 99%, or to about 75%, or to about 50%, or to about 40%, or to about 35%, or to about 30%, or to about 25%, or to about 20%, or to about 15%, or to about 10%, by weight of the composition, of conditioning active. The composition may include from about 5% to about 30%, by weight of the composition, of conditioning active.

Conditioning actives suitable for compositions of the present disclosure may include quaternary ammonium ester compounds, silicones, non-ester quaternary ammonium compounds, amines, fatty esters, sucrose esters, silicones, dispersible polyolefins, polysaccharides, fatty acids, softening or conditioning oils, polymer latexes, or combinations thereof.

The composition may include a quaternary ammonium ester compound, a silicone, or combinations thereof, preferably a combination. The combined total amount of quaternary ammonium ester compound and silicone may be from about 5% to about 70%, or from about 6% to about 50%, or from about 7% to about 40%, or from about 10% to about 30%, or from about 15% to about 25%, by weight of the composition. The composition may include a quaternary ammonium ester compound and silicone in a weight ratio of from about 1:10 to about 10:1, or from about 1:5 to about 5:1, or from about 1:3 to about 1:3, or from about 1:2 to about 2:1, or about 1:1.5 to about 1.5:1, or about 1:1.

The composition may contain mixtures of different types of conditioning actives. The compositions of the present disclosure may contain a certain conditioning active but be substantially free of others. For example, the composition may be free of quaternary ammonium ester compounds, silicones, or both. The composition may comprise quaternary ammonium ester compounds but be substantially free of silicone. The composition may comprise silicone but be substantially free of quaternary ammonium ester compounds.

The compositions of the present disclosure may contain a rheology modifier and/or a structurant. Rheology modifiers may be used to "thicken" or "thin" liquid compositions to a desired viscosity. Structurants may be used to facilitate phase stability and/or to suspend or inhibit aggregation of particles or droplets in liquid compositions, such as the droplets of the emulsions as described herein. Suitable rheology modifiers and/or structurants may include non-polymeric crystalline hydroxyl functional structurants (including those based on hydrogenated castor oil), polymeric structuring agents, cellulosic fibers (for example, microfibrillated cellulose, which may be derived from a bacterial, fungal, or plant origin, including from wood), di-amido gellants, or combinations thereof.

The consumer product compositions made from the presently described methods may include free perfume. To provide a broader and more diverse scent profile, it may be desirable to include perfume raw materials in the free perfume of the consumer product composition that are not present in the silicone emulsion, and/or vice versa. For example, when the silicone emulsion comprises one or more perfume raw materials that comprise an aldehyde moiety, the free perfume of the consumer product composition may comprise one or more perfume raw materials that do not comprise an aldehyde moiety. Similarly, when the silicone emulsion comprises one or more perfume raw materials that comprise a ketone moiety, the free perfume of the consumer product composition may comprise one or more perfume raw materials that do not comprise a ketone moiety. The free perfume may include perfume raw materials that include aldehyde moieties, perfume raw materials that do not include aldehyde moieties, perfume raw materials that include ketone moieties, perfume raw materials that do not include ketone moieties, or mixtures thereof.

The consumer product composition may comprise a carrier material. The carrier material may be selected from the group consisting of water, silica, zeolite, carbonate, polyvinyl alcohol, polyethylene glycol, sodium acetate, sodium bicarbonate, sodium chloride, sodium silicate, polypropylene glycol polyoxoalkylene, polyethylene glycol fatty acid ester, polyethylene glycol ether, sodium sulfate, starch, and mixtures thereof. The carrier material may be selected based on the desired final form of the consumer product; for example, a liquid product may use water as a carrier, whereas a powdered or particle product may use carbonate or polyethylene glycol (PEG).

The base composition may be in the form of a liquid. The base composition may comprise water. The base composition may comprise from about 1% to about 99%, preferably from about 5% to about 98%, or from about 10% to about 95%, or from about 50% to about 95%, or from about 60% to about 95%, or from about 75% to about 95%, by weight of the base composition, of water.

The consumer product composition may be in the form of a liquid. The consumer product composition may comprise water. The consumer product composition may comprise from about 1% to about 99%, preferably from about 5% to about 98%, or from about 10% to about 95%, or from about 50% to about 95%, or from about 60% to about 95%, or from about 75% to about 95%, by weight of the consumer product composition, of water. Certain unit dose formulations may have relatively low amounts of water so as to not dissolve the water-soluble film; for example, the composition may comprise no more than about 20%, or no more than about 15%, or no more than about 12%, or no more than about 10%, by weight of the composition, of water. The fragrance premixes of the present disclosure may be particularly useful in liquid compositions that include a relatively high amount of water, as it is believed the hydrophobicity of the silicone enables the silicone, aminofunctional material, and fragrance material to partition from the water and to associate in the high-water matrix.

The consumer product composition may be in a particulate form, such as a plurality of particulates. Individual particulates may have a mass from about 1 mg to about 1 g. The emulsion may be dispersed in a water-soluble carrier. The water-soluble carrier may be selected from the group consisting of polyethylene glycol, sodium acetate, sodium bicarbonate, sodium chloride, sodium silicate, polypropylene glycol polyoxoalkylene, polyethylene glycol fatty acid ester, polyethylene glycol ether, sodium sulfate, starch, and mixtures thereof. The water-soluble carrier may be a water-soluble polymer. The consumer product composition, when in particulate form, may comprise from about 25 wt % to about 99.99 wt % of the water-soluble carrier, and from about 0.01 wt % to about 50 wt % by weight the emulsion. The particulate form may be in the form of a bead or pastille.

Methods of Use

The present disclosure relates to methods of using the fragrance premix compositions and consumer products described herein. For example, a method of making a consumer product with a fragrance premix composition is described above.

The present disclosure also relates to a method of treating a surface, where the method comprises the step of contacting the surface with a consumer product composition described herein, optionally in the presence of water. Preferably, the surface is a fabric, hair, or skin, more preferably a fabric, even more preferably a garment.

The processes of the present disclosure may include diluting the composition with water to form a treatment liquor, which may contact the surface to be treated. The composition may be diluted from 100-fold to 1000-fold, or from 200-fold to 900-fold, or from 300-fold to 800-fold, by water.

The contacting step may occur in the drum of an automatic washing machine. The contacting step may occur as part of, or shortly before, a wash cycle; for example, the consumer product may be a detergent composition or may be added substantially concurrently with a detergent composition. The contacting step may occur as part of a rinse cycle, which may follow a wash cycle; for example, the consumer product may be a fabric enhancer product, such as a liquid fabric enhancer product, and may contact the surface subsequent to the surface having been treated by a detergent product.

The contacting step may occur as a pretreatment step, for example prior to a wash cycle.

COMBINATIONS

Specifically contemplated combinations of the disclosure are herein described in the following lettered paragraphs. These combinations are intended to be illustrative in nature and are not intended to be limiting.

A. A fragrance premix composition comprising: from about 30% to about 98%, by weight of the fragrance premix composition, of a silicone polymer, wherein the silicone polymer is characterized by at least one of the following: (a) an Extraction Percentage (Extr. %) of less than less than 8, after 24 hours, (b) a solubility in water of less than about 1000 mg/L, measured at 21° C., (c) an amine content of from 0.0 to about 3, preferably from about 0.0 to about 2.2, or (d) a nitrogen weight percent of from 0.0% to about 4%, or from about 0.1% to about 4%, or from about 0.1% to about 3%, or from about 0.1% to about 2%, or from about 0.2% to about 1.5%, or from about 0.2% to about 1.0%, or from about 0.3% to about 0.8%, or from about 0.3% to about 0.75%, reported as functional group equivalent weight %; from about 1% to about 20%, by weight of the fragrance premix composition, of an aminofunctional material, wherein the aminofunctional material is characterized by a molecular weight of less than about 1000 Daltons, and wherein the aminofunctional material comprises at least one amine moiety selected from a primary amine moiety, a secondary amine moiety, or a combination thereof; and from about 0.5% to about 25%, by weight of the fragrance premix composition, of a fragrance material comprising one or more perfume raw materials, wherein the one or more perfume raw materials comprises an aldehyde moiety, a ketone moiety, or combinations thereof; wherein a mixture of the silicone polymer, the aminofunctional material, and the one or more perfume materials in a 9.9:0.1:0.1 weight ratio is characterized by a % Transmittance (% T) of at least 40 at 480 nm.

B. The fragrance premix composition according to paragraph A, wherein the silicone polymer is characterized by an Extraction Percentage (Extr. %) of less than less than 5, or less than 4, or less than 2, or less than 1, or less than 0.5, or even less than 0.1, after 24 hours.

C. The fragrance premix composition according to any of paragraphs A or B, wherein the silicone polymer is characterized by a solubility in water of less than about 800 mg/L, or less than about 600 mg/L, or less than about 500 mg/L, measured at 25° C.

D. The fragrance premix composition according to any of paragraphs A-C, where in the silicone polymer is characterized by a total amine content, preferably a primary amine content, of from about from 0.05 to about 3, preferably from about 0.05 to about 2.2, preferably from about 0.071 to about 2.14, or from about 0.071 to about 1.78, or from about 0.71 to about 1.43, or from about 0.14 to about 1.07, or from about 0.14 to about 0.71, or from about 0.21 to about 0.71, or from about 0.36 to about 0.71.

E. The fragrance premix composition according to any of paragraphs A-D, wherein the silicone polymer comprises a cyclic silicone polymer, a polydimethylsiloxane (PDMS) polymer, or an aminofunctional silicone polymer, preferably PDMS or an aminofunctional silicone polymer, more preferably an aminofunctional silicone polymer comprising primary amine moieties.

F. The fragrance premix composition according to any of paragraphs A-E, wherein the aminofunctional material is characterized by a molecular weight of from about 40 to about 1000 Daltons, preferably from about 50 to 800 Daltons, more preferably from about 60 to about 600 Daltons, even more preferably from about 60 to about 500 Daltons.

G. The fragrance premix composition according to any of paragraphs A-F, wherein the aminofunctional material is characterized by one or both of the following: (a) an Amine Equivalent Weight of about 25 to 300, preferably from about 50 to about 180, more preferably from about 60 to about 130 g/mol; and/or (b) a Hydrophilic Group Equivalent Weight of greater than 100.

H. The fragrance premix composition according to any of paragraphs A-G, wherein the aminofunctional material is characterized by one of the following: (a) comprising a total of one primary amine moiety and no secondary amine moieties; (b) comprising a total of two primary amine moieties and no secondary amine moieties; (c) one primary amine moiety and one secondary amine moiety, preferably where the primary amine moiety and the secondary amine moiety are separated by two carbon atoms; or (d) one primary amine moiety or secondary amine moiety that is separated by two carbon atoms from a hydroxyl group.

I. The fragrance premix composition according to any of paragraphs A-H, wherein the aminofunctional material is selected from the group consisting of: (a) an aliphatic aminofunctional material, preferably an aliphatic aminofunctional material selected from the group consisting of: octylamine; nonylamine; decylamine; 2-ethylhexylamine; tridecylamine, branched; t-butylamine; neopentanediamine (2,2-dimethyl propane-1,3-diamine); trimethyl-1,6-hexanediamine; 2-aminoheptane; 2-butyloctylamine; and mixtures thereof; (b) a cycloaliphatic aminofunctional material, preferably a cycloaliphatic aminofunctional material selected from the group consisting of: 2-methylcyclohexane-1,3-diamine; 4-methylcyclohexane-1,3-diamine; 4-(2-aminopropan-2-yl)-1-methylcyclohexan-1-amine; cyclohexane-1,2-diamine; cyclohexane-1,3-diyldimethanamine; cyclohexane-1,3-diamine; cyclohexane-1,4-diamine; 3-(aminomethyl)-3,5,5-trimethylcyclohexan-1-amine; 4,4'-methylenebis(2-methylcyclohexan-1-amine; 4,4-methylenebis(cyclohexan-1-amine; cyclohexane-1,2-diyldimethanamine; cycloheptanamine; 4-methylcyclohexan-1-amine; cyclohexanamine; 4,4-(propane-2,2-diyl)bis(cyclohexane-1-amine; and mixtures thereof; (c) an aminofunctional silane, preferably an aminofunctional silane selected from the group consisting of trialkoxy(aminoethylaminopropyl)silane, alkyl dialkoxy(aminoethylaminopropyl)silane, dialkyl alkoxy(aminoethylaminopropyl)silane, trialkoxy(aminopropyl)silane, alkyl dialkoxy(aminopropyl)silane, dialkyl alkoxy(aminopropyl)silane, and mixtures thereof, more preferably an aminofunctional silane selected from the group consisting of trimethoxy(aminoethylaminopropyl)silane, triethoxy(aminoethylaminopropyl)silane, methyl dimethoxy(aminoethylaminopropyl)silane, ethyl dimethoxy(aminoethylaminopropyl)silane, dimethyl methoxy(aminoethylaminopropyl)silane, dimethyl ethoxy(aminoethylaminopropyl)silane, trimethoxy(aminopropyl)silane, triethoxy(aminopropyl)silane, methyl dimethoxy(aminopropyl)silane, ethyl dimethoxy(aminopropyl)silane, dimethyl methoxy(aminopropyl)silane, dimethyl ethoxy(aminopropyl)silane, and mixtures thereof; (d) an aminoalcohol where a primary amine moiety or secondary amine moiety is separated by two carbon atoms from a hydroxyl group, preferably an aminoalcohol selected from the group consisting of 2-(butylamino)ethanol, 1-(cyclohexylamino)2-propanol, 1-(dodecyloxy)-3-[(2-hydroxyethyl)amino]-2-propanol, 3-(dodecylamino)-1,2-propanediol, and mixtures thereof; (e) 1,3-bis(3-aminopropyl) tetramethyldisiloxane; or (f) mixtures thereof.

J. The fragrance premix composition according to any of paragraphs A-I, wherein the one or more perfume raw materials comprise an aldehyde moiety.

K. The fragrance premix composition according to any of paragraphs A-J, wherein the one or more perfume raw materials comprise a ketone moiety.

L. The fragrance premix composition according to any of paragraphs A-K, wherein the one or more perfume raw materials comprise a material selected from the following: (a) oncidal, methyl nonyl acetaldehyde, adoxal, melanal, calypsone, or mixtures thereof; (b) cuminic aldehyde, benzaldehyde, anisic aldehyde, heliotropin, isocyclocitral, triplal/ligustral, 3,6-ivy carbaldehyde, ligustral, scentenal, or mixtures thereof; (c) satinaldehyde (jasmorange), otropal, cyclamen homoaldehyde, cyclamen aldehyde (cyclamal), lilial, canthoxal, floralozone, cinnemic aldehyde, or mixtures thereof; (d) delta-damascone, beta-damascone, alpha-damascone, nectaryl, or mixtures thereof; (e) vanillin; ethyl vanillin; octahydro-4,7-methano-1H-indene-5-acetaldehyde; 3-[4-(2-methylpropyl)cyclohexyl]propanal; or mixtures thereof; or (f) a combination of materials selected from at least two categories of a, b, c, d, and e.

M. The fragrance premix composition according to any of paragraphs A-L, wherein the total moles of primary and secondary amine moieties present in the composition as provided by the silicone polymer and the aminofunctional material is X, wherein the total moles of aldehyde moieties and/or ketone moieties present in the composition as provided by the one or more perfume raw materials is Y, and wherein the ratio of X:Y is from about 2:1 to about 1:20, from about 2:1 to about 1:10, preferably from about 2:1 to about 1:5, more preferably from about 2:1 to about 1:2, more preferably from about 1.5:1 to about 1:1.5, more preferably from about 1:1 to about 1:1.5.

N. The fragrance premix composition according to any of paragraphs A-M, wherein the fragrance premix composition comprises: from about 40% to about 95%, or from about 50% to about 90%, or from about 60% to about 85%, by weight of the fragrance premix composition, of the silicone polymer; or from about 2% to about 15%, or from about 3% to about 12%, or from about 4% to about 10%, or from about 5% to about 10%, by weight of the fragrance premix composition, of the aminofunctional material; or from about 1% to about 20%, or from about 2% to about 20%, or from about 5% to about 20%, or from about 10% to about 20%, or from about 15% to about 20%, by weight of the fragrance premix composition, of the one or more perfume raw materials; or a combination thereof.

O. The fragrance premix composition according to any of paragraphs A-N, wherein the mixture of the silicone compound, the aminofunctional material, and the one or more perfume materials in a 9.9:0.1:0.1 weight ratio is characterized by a % Transmittance (% T) at 480 nm of at least 50, or at least 60, or at least 75, or at least 80, or at least 85, or at least 90, or at least 95, or at least 98.

P. The fragrance premix composition according to any of paragraphs A-O, wherein the fragrance premix composition is an emulsion, preferably an oil-in-water emulsion, preferably an oil-in-water emulsion characterized by a plurality of droplets having a mean diameter of from about 1 micron to about 10 microns, preferably from about 1 micron to about 5 microns.

Q. The fragrance premix composition according to any of paragraphs A-P, wherein the fragrance premix composition comprises water, preferably from about 1% to about 90%, or from about 1% to about 75%, or from about 1% to about 60%, or from about 1% to about 50%, or from about 5% to about 50%, or from about 10% to about 50%, or from about 25% to about 50%, by weight of the composition, of water.

R. A process of making the fragrance premix composition according to any of paragraphs A-Q, the process comprising the steps of: providing the silicone polymer; adding the aminofunctional material; optionally adding the emulsifying agent; optionally adding the water; and adding the fragrance material.

S. A consumer product comprising: the fragrance premix composition of any of paragraphs A-Q, and a consumer product adjunct.

T. A consumer product comprising a consumer product adjunct and a plurality of droplets, the droplets comprising: a silicone polymer, wherein the silicone polymer is characterized by at least one of the following: (a) an Extraction Percentage (Extr. %) of less than less than 8, after 24 hours, and/or (b) a solubility in water of less than about 1000 mg/L, measured at 21° C., and/or (c) an amine content of from 0.0 to about 3, preferably from about 0.0 to about 2.2, and/or (d) a nitrogen weight percent of from 0.0% to about 4%, or from about 0.1% to about 4%, or from about 0.1% to about 3%, or from about 0.1% to about 2%, or from about 0.2% to about 1.5%, or from about 0.2% to about 1.0%, or from about 0.3% to about 0.8%, or from about 0.3% to about 0.75%, reported as functional group equivalent weight %; an aminofunctional material, wherein the aminofunctional material is characterized by a molecular weight of less than about 1000 Daltons, and wherein the aminofunctional material comprises at least one amine moiety selected from a primary amine moiety, a secondary amine moiety, or a combination thereof; and one or more perfume raw materials, wherein the one or more perfume raw materials comprises an aldehyde moiety, a ketone moiety, or combinations thereof, preferably wherein a mixture of the silicone polymer, the aminofunctional material, and the one or more perfume materials in a 9.9:0.1:0.1 weight ratio is characterized by a % Transmittance (% T) of at least 40 at 480 nm.

U. The consumer product according to any of paragraphs S or T, the consumer product further comprising a carrier material, preferably a carrier material selected from the group consisting of water, silica, zeolite, carbonate, polyvinyl alcohol, polyethylene glycol, sodium acetate, sodium bicarbonate, sodium chloride, sodium silicate, polypropylene glycol polyoxoalkylene, polyethylene glycol fatty acid ester, polyethylene glycol ether, sodium sulfate, starch, and mixtures thereof.

V. The consumer product according to any of paragraphs S-U, wherein the consumer adjunct comprises a material selected from the group consisting of selected from a surfactant system, a water-binding agent, a sulfite, fatty acids and/or salts thereof, enzymes, encapsulated benefit agents, soil release polymers, hueing agents, builders, chelating agents, dye transfer inhibiting agents, dispersants, enzyme stabilizers, catalytic materials, bleaching agents, bleach catalysts, bleach activators, polymeric dispersing agents, soil removal/anti-redeposition agents, polymeric dispersing agents, polymeric grease cleaning agents, brighteners, suds suppressors, dyes, hueing agents, free perfume, structure elasticizing agents, fabric softening agents, carriers, fillers, hydrotropes, organic solvents, anti-microbial agents and/or preservatives, neutralizers and/or pH adjusting agents, processing aids, fillers, rheology modifiers or structurants, opacifiers, pearlescent agents, pigments, anti-corrosion and/or anti-tarnishing agents, and mixtures thereof.

W. The consumer product according to any of paragraphs S-V, wherein the consumer product is in the form of a liquid composition, a granular composition, a single-compartment pouch, a multi-compartment pouch, a dissolvable sheet, a pastille or bead, a fibrous article, a tablet, a bar, a flake, a non-woven sheet, or a mixture thereof, preferably wherein the consumer product is in the form of a liquid composition, more preferably comprising from about 1% to about 99%, preferably from about 5% to about 98%, or from about 10% to about 95%, or from about 50% to about 95%, or from about 60% to about 95%, or from about 75% to about 95%, by weight of the consumer product composition, of water.

X. The consumer product composition according to any of paragraphs S-W, wherein the consumer product composition is a household care composition, preferably a household care composition selected from the group consisting of a fabric and home care product, a beauty care product, or a mixture thereof, wherein if said consumer product is a fabric and home care product, preferably the fabric and home care product is selected from a laundry detergent composition, a fabric conditioning composition, a laundry and rinse additive, a fabric pre-treatment composition, a fabric refresher composition, or a mixture thereof; and wherein if the consumer product is a beauty care product, preferably the beauty care product is selected from a hair treatment product, a skin care product, a shave care product, a personal cleansing product, a deodorant and/or antiperspirant, or a mixture thereof.

Y. A method of making the consumer product according to any of paragraphs S-X, the method comprising the step of combining the composition with the consumer product adjunct.

Z. A method of treating a surface, preferably wherein the surface is a fabric, the method comprising the steps of contacting the surface with the consumer product according to any of paragraphs S-X, optionally in the presence of water.

Test Methods

Miscibility Test—Measuring the Miscibility in Silicones Via UV-Vis % Transmittance The relative miscibility of the components described herein is determined by measuring the percentage of light transmittance through samples using a UV-Vis Spectrophotometer operated in transmission mode, at 480 nm, using 1 cm path length cuvettes (VWR 97000-588), in accordance with the following procedure. Suitable instruments include the Beckman Coulter DU800, ID #1159577, MV31994, SN #8003432.

All sample preparations and analyses are conducted in a laboratory with air temperature of 22° C.+/−2° C. In a glass scintillation vial combine the predominant silicone present in the composition, along with the aminofunctional amine to be tested (for example, ethyl hexyl amine), at the ratio of 9.9:0.1 wt/wt. Cap the vial and mix the materials thoroughly for 5 minutes using a benchtop vortex mixer set to its highest speed. If two or more distinct layers of materials are clearly visible by eye in the vial after mixing, then the miscibility of the test material is considered to be indeterminate via this method. If distinct layers are not clearly visible by eye, then continue with the analysis.

Turn on the spectrophotometer lamps and allow them to warm up for 30 minutes prior to commencing measurements. Set the instrument to collect the measurement in Percentage Transmission (% T) mode, at a wavelength of 200-800 nm. Load all samples into 1 cm path length plastic cuvettes. If air bubbles are visible in the cuvettes, use a pipette to remove the bubbles, or let the bubbles settle out of the cuvette prior to measurement. Water, if present, should be removed (e.g., with a rotary evaporator) from the mixtures prior to taking the % T measurement.

Zero the baseline (run as the blank) with the respective neat silicone sample (see Table). Measure the % T of the mixture (for example, of the silicone & aminofunctional material, or of silicone+aminofunctional material+perfume raw material), as prepared under the previous instructions.

Report % T at 480 nm. Mixtures showing a relatively high % T indicate relatively good miscibility.

Extraction Percentage (Extr. %) of Silicone

To determine the Extraction Percentage (Extr. %) of a silicone polymer, a sample at 1:100 polymer-to-DI-water weight ratio is prepared generally following OECD 120 guidelines. (This method is substantially based on the OECD 120 guidelines as of the first filing date of this disclosure; the OECD 120 guidelines should be used to fill in any gaps in this method, should any exist.) Approximately 0.2 g of silicone polymer is spread evenly onto the bottom of a 250 mL polypropylene tri-pour cup, spreading across total surface area of bottom of beaker. 20 mL of DI water is pipetted to the polymer-containing cup, taking care not to disturb the polymer layer at the bottom. Beakers are covered with parafilm and placed on an orbital shaker at very low speed (mimicking the gentle motion of environmental water) for 24 hours and 6 days, at room temperature (approx. 21° C.). Each polymer is prepared in duplicate for each time point.

After the designated time, a 10 mL aliquot of water from each beaker is pipetted into a 15 mL centrifuge tube containing 300 uL of tetrahydrofuran (THF) and 50 μL of 100 ppm yittrium (aq). (In some cases, dilution with DI water may be necessary to stay within calibration range).

Samples are analyzed by inductively coupled plasma optimal emissions spectroscopy (ICP-OES) against an external calibration curve of either inorganic silicon or against a calibration curve of the silicone polymer being tested. Data is reported in polymer equivalents either by converting inorganic silicon to polymer equivalents using the silicon content of each polymer or reported straight from the polymer calibration curve.

The Extraction Percentage (Extr. %) of each polymer after a given time period (e.g., 24 hours and/or 6 days) is calculated from the mass of polymer equivalents measured in the aqueous phase versus the mass of the original polymer weighed into the tri-pour cup. Results are reported as Extr. %.

Determination of Amine Content and % Nitrogen

Total amine content, primary amine content, and/or % nitrogen of an aminofunctional silicone is determined according to the following method. More specifically, this method is used to determine the primary, secondary and tertiary amine values (meq/g) which are defined as the milliequivalents of amine functionality (primary, secondary and tertiary) present in one gram of a sample.

The method is based on compendial method ASTM D2074-07, which should be used to supplement this method if necessary. In broad stokes, a sample is dissolved in isopropyl alcohol and is titrated to a bromophenol blue end point using a standardized HCl solution.

The following materials are used: 0.1N Hydrochloric Acid in isopropyl alcohol (CAS 7647-01-1, 67-63-0; 99.5%; ex Fisher Scientific); Isopropyl Alcohol (CAS #67-63-0; 99%; ex EMD); Phenyl Isothiocyanate (CAS #103-72-0; 98%; ex Sigma Aldrich); Salicylaldehyde (CAS #90-02-8; 98%; ex Sigma Aldrich); Bromophenol Blue Indicator (0.1 wt % solution in ethanol or isopropyl alcohol; ex. Fisher Scientific).

Each of the following titrations should be repeated a total of three times. Furthermore, titrant volumes must be determined empirically. Titrant volumes should be between 1 and 20 mL. If titrant volumes are less than 1 mL, weigh more sample. If samples are more than 20 mL, weigh less sample. A buret such as Metrohm Dosimat 775 or equivalent may be used in the titrations. Regarding the yellow end point of the titrations—the yellow may fade back to green, but if it is a bright clear yellow, this is to be disregarded if additional 0.1N HCl does not change the original color.

A. Titration for Total Amine Content

Melt the sample (typically 100% active) in a water bath if it is not already a liquid. Mix thoroughly and accurately weigh out between 0.5 grams and 1.0 grams into a 250 mL Erlenmeyer flask (wide mouth; alkali resistant). Record the weight to four decimal places.

To the flask, add 50 mL of isopropyl alcohol. Add 0.5 mL of bromophenol blue indicator. Titrate with 0.1N HCl solution while swirling until it reaches the yellow end point. Record the volume of HCl used as $V_{1,2,3}$.

B. Titration for Secondary and Tertiary Amine Content

Melt the sample (typically 100% active) in a water bath if it is not already a liquid. Mix thoroughly and accurately weigh out 1.0 grams into two 250 Erlenmeyer flasks. Record the weight to four decimal places. Mark the flasks S and T, respectively. To each flask, add 50 mL of isopropyl alcohol.

To flask S, add 1 mL of salicylaldehyde. Stir the solution (with a magnetic stir bar) for 30 minutes. Add 0.5 mL of bromophenol blue indicator solution and titrate while stirring with 0.1N HCl to a yellow end point. Record volume of HCl used as $V_2$&3.

To flask T, add 1 mL of phenyl isothiocyanate. Stir the solution (with a magnetic stir bar) for 30 minutes. Add 0.5 mL of bromophenol blue indicator solution and titrate while stirring with 0.1N HCl to a yellow end point. Record volume of HCl used as $V_3$.

C. Calculations for Amine Content

The variables in the calculations described below correspond to the following:

V: HCl required for titration of specimen in mL

N: normality of the HCl solution

S: specimen weight in grams (g)

meq/g: milliequivalents/gram

Total: Total Amine Value

AS: Amine value of the secondary and tertiary amine groups

TA: Tertiary Amine Value

Based on the measurements obtained related to the above titrations, the following calculations are used to determine the various amine contents.

$$\text{Total Amine Value (Total)} = \frac{(V_{1,2,3} * N)\ (\text{meq/g})}{S}$$

$$\text{Secondary and Teritary Amine Value } (AS) = \frac{(V_{2,3} * N)\ (\text{meq/g})}{S}$$

$$\text{Tertiary Amine Value } (TA) = \frac{(V_3 * N)\ (\text{meq/g})}{S}$$

$$\text{Secondary Amine Value} = (AS - TA)$$

$$\text{Primary Amine Value} = (\text{Total} - AS)$$

D. Calculation of Nitrogen wt %

To determine the wt % of nitrogen in an aminofunctional silicone based on the amine content, use the following calculation.

The weight percentage of nitrogen in a compound can be calculated from the amine value (in meq/g) as follows:

$$(\text{Amine Value}/1000)\times(\text{MW of Nitrogen})\times 100 = \text{wt \% Nitrogen}$$

As an example, dimethylethanolamine has an amine value of 11.2 (in meq/g). Its weight percent of nitrogen (15.7 wt %) is as follows:

$$(11.2/1000)\times(14.01)\times 100 = 15.7 \text{ wt \% nitrogen}$$

The following table shows wt % of nitrogen and equivalent amine values.

| Wt % Nitrogen | Amine Value (meq/g) |
|---|---|
| 0.1 | 0.071 |
| 0.2 | 0.14 |
| 0.3 | 0.21 |
| 0.5 | 0.36 |

-continued

| Wt % Nitrogen | Amine Value (meq/g) |
|---|---|
| 0.7 | 0.50 |
| 0.8 | 0.57 |
| 1.0 | 0.71 |
| 1.5 | 1.07 |
| 2.0 | 1.43 |
| 2.5 | 1.78 |
| 3.0 | 2.14 |
| 3.5 | 2.50 |

If the aminofunctional material contains nitrogen atoms that are not in the form of primary, secondary, and/or tertiary amines, the nitrogen content as a weight percent may be determined according to methods known to those having ordinary skill in the art.

E. Standard

To confirm quality control of the method, a suitable standard may be run—for example, dimethylethanol amine (a tertiary amine; 99.5%; available from Sigma Aldrich). For this particular amine, total amine and tertiary amine content should be 11.2±0.2 meq/g. Primary and Secondary amine content should be <0.1 meq/g.

Viscosity Test Method

The following test method is used to determine the viscosity of an aminofunctional silicone and/or an emulsion containing such a silicone.

A preliminary estimate of the sample viscosity at 25° C. is used to select the appropriate instrument geometry to be used during the final viscosity measurement analyses, which are conducted on a model AR-G2 Rheometer (manufactured by TA Instruments Corp., New Castle, Del., USA). A preliminary estimate of the sample viscosity may be obtained by using a Brookfield Viscometer (Brookfield Engineering Laboratories Inc., Middleboro, Mass., USA). The selection of geometry for use on the AR-G2 Rheometer is determined in accordance with the following table:

AR-G2 Geometry Selection

| Preliminary Estimate of Sample Viscosity | AR-G2 Geometry and Plate Size |
|---|---|
| >1000 Pa*s | 25 mm parallel plate |
| 1 to 1000 Pa*s | 40 mm parallel plate |
| >Water-thin to <1 Pa*s | 60 mm parallel plate |
| Water-thin | Couette/Cup and Bob |

The geometry attached to the instrument, the instrument is mapped, the gap distance is zeroed, and the instrument temperature is set to 25° C. The measurement mode is selected as Stiff Mode when using parallel plates, or to Soft mode when using the couett cup and bob geometry. Sample material is mounted into the sample holding geometry e.g., the base plate. The minimum gap distance allowable between the base plate and the selected geometry is 10× the diameter of the largest common particle present in sample. If there are common particles in the sample which have a diameter greater than 100 μm (as determined microscopically), then the gap value is set to 10× the diameter of the largest common particle, otherwise the gap distance is set to the default value of 1000 μm (ie 1 mm). The selected geometry is lowered to the appropriate gap and a plastic tool is used to trim off any excess sample material. The sample material is allowed to equilibrate to the temperature of the instrument. Three rheological measurement analyses are conducted, namely: Flow Curve, Stress Sweep, and Frequency Sweep, using the following selections and settings:

Flow Curve: select Stepped Flow 0.01 to 100; 10 pts/decade; shear stress; constant time 20; average last 10.

Stress Sweep: set the Stress Range as 0.01 to 100 Pa; set the Frequency at 1 rad/s.

Frequency Sweep: Set the Angular Frequency Range as 0.1 to 100.

To ensure that the analysis is conducted within the Linear Viscoelastic Region set the Stress value at a third of the stress value that was present when G' started to degrade during the prior Stress Sweep analysis.

The viscosity value for the test material obtained at 25° C. is reported, for example at 0.1 rad/s.

Particle/Droplet Size

The droplet size for the siloxane compounds are analyzed as the emulsion and in the fabric softener utilizing a Horiba, Partica, Laser Scattering, Particle Size Distribution Analyzer LA-950V2 with a static quartz cell and operated in accordance with the manufacturer's instructions.

HLB Value of Nonionic Surfactants

Nonionic surfactants can be classified by the balance between the hydrophilic and lipophilic moieties in the surfactant molecule. The hydrophile-lipophile balance (HLB) scale devised by Griffin in 1949 is a scale from 0-20 (20 being Hydrophilic) used to characterize the nature of surfactants. The HLB of a surfactant may be calculated as follows:

$$HLB=20*Mh/M$$

where Mh is the molecular of the hydrophilic portion of the molecule, and M is the molecular mass of the whole molecule, giving a result on a scale of 0 to 20. An HLB value of 0 corresponds to a completely lipophilic/hydrophobic molecule, and a value of 20 corresponds to a completely hydrophilic/lipophobic molecule. See Griffin, W. C. Calculation of HLB values of Nonionic Surfactants, J. Soc. Cosmet. Chem. 1954, 5, 249-256. The HLB values for commonly-used surfactants are readily available in the literature (e.g., HLB Index in McCutcheon's Emulsifiers and Detergents, MC Publishing Co., 2004). The HLB value for a mixture of surfactants can be calculated as a weighted average of the HLB values of the surfactants.

Fabric Treatment Method

Test fabrics are treated with fabric conditioning compositions in a miniwasher according to the following procedure.

Five full-sized cotton terry cloths (30 cm×30 cm) (or their equivalent: e.g., ten half-sized terries, or twenty quarter-sized terries) are used for each test leg. The terries are pre-conditioned with three cycles of liquid detergent and fabric softener, both of which are free of perfumes.

Weigh out desired number of detergent doses into plastic cups and secure with lids such that each dose of detergent is 9.98 g (+/−0.02 g) for each treatment for each cycle. For example, if five treatments of one wash cycle is being run, five doses of detergent would be needed, one dose for each treatment. Repeat the same process with the liquid fabric softener samples such that each dose is 5.68 g (+/−0.02 g) for each treatment.

For the test, the following treatment conditions are used:

Machine Type: Miniwasher (designed to mimic top-loader conditions)

Machine Cycle: 80 spm (normal)

Wash Temp: approx. 30.6° C. (87° F.)

Rinse Temp: approx. 15.6° C. (60° F.)

Water Hardness: about 100 ppm (6 gpg)

Wash Time: 12 mins

Rinse Time: 2 mins

Water Volume: 2 gal fill (~8 L)

Dry Type: Electric

Turn on the mini-washer and water mixing station. Set the water mixing station using the water specifications mentioned above. Fill each drum of the mini-washer to the 2 gal line, adding the detergent to each drum respectively while the drum is filling. Rinse the cup with the water coming into the drum such that all of the detergent is added to and well dispersed throughout the drum. Once the drums are filled with water and the dispersed detergent, add the fabrics and set the agitation time to 12 mins. At the end of the agitation time, set the spin timer to 2 mins to allow the water to spin out of the drum. Once the spin cycle is complete, remove the fabrics from each drum ensuring each fabric bundle remains separate from the others. Start the fill cycle again using the water specifications for the rinse cycle to the 2 gal line (the water mixing station should automatically switch to the rinse water specifications). During the fill cycle, add the liquid fabric softener dose to each drum respectively. Ensure complete addition and dispersion of the liquid fabric softener composition by rinsing the dosing cup with the incoming water. Once the drum is filled with water and the dispersed fabric softener, the fabrics can be added back to each respective drum. Set the agitation cycle to 2 mins and allow to run. After the agitation is complete, set the spin cycle to 2 mins to allow all of the water to spin out. After completing the spin cycle, each fabric bundle is placed into a separate electric dryer and dried on a high/cotton setting. Once the fabrics are dry, they are placed in a constant temperature/constant relative humidity room set at 75 F and 50% relative humidity for at least 4 hrs (preferably overnight) to equilibrate.

Headspace Analysis on Fabric

To prepare the treated fabric for analysis, cut one 2.54 cm×5.08 cm (1 inch×2 inch) cotton swatch from the cotton terry that is prepared and treated according to the above methods. Place each piece in a 20 mL headspace vial. Re-equilibrate for four hours in a Controlled Humidity and Temperature room (21 C/50% humidity). After the four hours the vials are capped and analyzed via Headspace solid phase micro-extraction/Gas Chromatography/Mass Spectrometry.

The equipment used for analysis is as follows: Gas Chromatograph 7890B equipped with a Mass Selective Detector (5977B) (MSD) and Chemstation quantitation package; Gerstel Multi-Purpose sampler equipped with a solid phase micro-extraction (SPME) probe or similar system; Divinylbenzene/Carboxen/Polydimethylsiloxane SPME fiber from Supleco part #57298-U (or similar fiber); column with 30 m×0.25 mm nominal diameter, 0.25 μm film thickness, J&W 122-5532UI DB-5; 20 mL headspace vials.

The Gerstel auto sampler parameters are as follows: SPME—from Incubator; Incubation Temperature—65° C.; Incubation Time—10.00 min SAMPLE PARAMETERS; Vial Penetration—22.00 mm; Extraction Time—5.00 min; Inj. Penetration—54.00 mm; Desorption Time—300 s.

The GC oven parameters are as follows for the Front SS Inlet He: Mode—Splitless; Heater—270° C.; GC Run Time—14.28 min. For the Oven: Initial temp.—40° C.; Hold Time—0.5 min; Heating Program—Rate of 17° C./min, Temp of 270° C., Hold Time of 0.25.

The MSD parameters are as follows: Run in scan mode with a minimum range of 35 to 350 m/z; calibration curves are generated from the standards perfume material; Chemstation software (or similar quantitation software) calculates this amount using the quantitation software for each perfume component.

EXAMPLES

The examples provided below are intended to be illustrative in nature and are not intended to be limiting.

Example 1. Characteristics of Certain Silicone Polymers

The following tables provide characteristics of certain silicone polymers. The silicones of the same numbers ("Silicone No.") in Tables 1A, 1B, and 1C correspond to each other. Some of the silicones (e.g., Silicone Nos. 7-10) may be outside the scope of the silicones useful in the present premixes and/or consumer product compositions. For example, the amine content and/or Extr. % may be relatively too high, or the molecular weight too low, which may be associated with relatively greater solubility in water.

TABLE 1A

| Silicone No. | Silicone Description | Product Code | Approx. Molecular Weight |
|---|---|---|---|
| 1 | Polydimethylsiloxane (PDMS) | Gelest DMS-T31 | 28000 |
| 2 | Aminosilicone | Shin-Etsu X-22-8742 | ~35000 |
| 3 | Aminosilicone | Shin-Etsu KF-861 | ~35000 |
| 4 | Aminosilicone | Shin-Etsu KF-867S | ~25000 |
| 5 | Aminosilicone | Shin-Etsu KF-8003 | ~30000 |
| 6 | Aminosilicone | Shin-Etsu KF-393 | ~3000 |
| 7 | Aminopropyl terminated PDMS | Gelest DMS-A11 | 900 |
| 8 | 3-Aminopropylmethyl bis(trimethylsiloxy)silane | Gelest SIA0604.5 | 280 |
| 9 | 1,3-Bis(3-aminopropyl) tetramethyldisiloxane | Gelest SIB1024.0 | 249 |
| 10 | 1,3-Bis(2-aminoethylaminomethyl) tetramethyldisiloxane | Gelest SIB1021.5 | 279 |

In Table 1B, the variables (R1-R4, X, Z) and indices (j, k, m) correspond to the corresponding moieties in Formula (I) and Formula (II), described in more detail above in the section related to the silicone. Silicone No. 1 is a silicone according to Formula (I); Silicone Nos. 2-10 are silicones according to Formula (II).

TABLE 1B

| Silicone No. | R1 | R2, R3, R4 | X | Z | j | k | m |
|---|---|---|---|---|---|---|---|
| 1 | —$CH_3$ | —$CH_3$ | n/a | n/a | 0* | 0 | ~375 |
| 2 | —$CH_3$ | —$CH_3$ | —$(CH_2)_3$— | —NH—$(CH_2)_2NH_2$ | 0 | ~10 | ~475 |
| 3 | —$CH_3$ | —$CH_3$ | —$(CH_2)_3$— | —NH—$(CH_2)_2NH_2$ | 0 | ~10 | ~475 |
| 4 | —$CH_3$ | —$CH_3$ | —$(CH_2)_3$— | —NH—$(CH_2)_2NH_2$ | 0 | ~7 | ~330 |
| 5 | —$CH_3$ | —$CH_3$ | —$(CH_2)_3$— | —$NH_2$ | 0 | ~21 | ~450 |
| 6 | —$CH_3$ | —$CH_3$ | —$(CH_2)_3$— | —NH—$(CH_2)_2NH_2$ | 0 | ~4 | ~28 |
| 7 | —X—Z | —$CH_3$ | —$(CH_2)_3$— | —$NH_2$ | 0 | 0 | ~9 |
| 8 | —$CH_3$ | —$CH_3$ | —$(CH_2)_3$— | —$NH_2$ | 0 | 1 | 0 |
| 9 | —X—Z | —$CH_3$ | —$(CH_2)_3$— | —$NH_2$ | 0 | 0 | 0 |
| 10 | —X—Z | —$CH_3$ | —$CH_2$— | —NH—$(CH_2)_2NH_2$ | 0 | 0 | 0 |

*For Silicone No. 1, n = 2.

TABLE 1C

| Silicone No. | Wt % Nitrogen | Amine Content (meq./g) | Extr. % (after 24 hrs) |
|---|---|---|---|
| 1 | 0 | 0 | 0.0024 |
| 2 | 0.84 | 0.6 | 0.47 |
| 3 | 0.84 | 0.6 | 0.68 |
| 4 | 0.82 | 0.59 | 0.68 |
| 5 | 0.73 | 0.52 | 0.83 |
| 6 | −4.0 | 2.86 | 4.2 |
| 7 | −3.1 | 2.21 | 10 |
| 8 | 5.1 | 3.64 | 33 |
| 9 | 11.3 | 8.07 | 51 |
| 10 | 20.1 | 14.28 | 55 |

Example 2. Miscibility of Certain Silicone Polymers and Aminofunctional Materials In this experiment, different combinations of silicone polymers and aminofunctional materials are tested (at a 99:1 weight ratio) according to the Miscibility Test provided in the Test Methods section above. Descriptions for the silicone polymers are provided above in Example 1.

Table 2 shows the results of the Miscibility Test for each of the following combinations. Generally, relatively higher % T values show better miscibility and are preferred. More specifically, % T values equal to or greater than 90 is most preferred, followed by a preference for a % T of from 60 to less than 90, followed by a preference for a % T of from about 40 to less than 60.

TABLE 2

| | Leg A | Leg B | Leg C | Leg D |
|---|---|---|---|---|
| | Silicone (99 parts): | | | |
| | DMS-T31 | KF-867S | KF-8003 | DMS-A11 |
| | Aminofunctional Material (1 part): | | | |
| | % T at 480 nm | | | |
| 1. Ethyl hexyl amine (2-ethylhexylamine) | 100.2 | 99.3 | 100.1 | 99.8 |
| 2. Methyl cyclohexyl diamine | 85.3 | 84.7 | 45.5 | 100 |
| 3. Butyl ethanol amine (2-(butylamino)ethanol) | 97 | 99.6 | 99.8 | 100.1 |
| 4. Xylene diamine | 6.6 | 0.2 | 0.2 | 100.5 |
| 5. PEI-800 Mw | 3.9 | 1.4 | 0.4 | 1.9 |
| 6. 1,2-Bis(3-aminopropylamino)ethane | 2.2 | 0.4 | 0.4 | 100.2 |
| 7. Ethanol amine | 25.7 | 2 | 0.8 | 99.7 |
| BLANK: | DMS-T31 | KF-867S | KF-8003 | DMS-A11 |

As shown in Table 2, different aminofunctional materials may have different miscibility with different silicones, as evidenced by different % T values; see, for example, methyl cyclohexyl diamine (aminofunctional material #2). Furthermore certain aminofunctional materials have low miscibility with the tested silicones, as evidenced by low % T values; see, for example, PEI-800 Mw (a polyethyleneimine polymer having a molecular weight of approximately 800), which is likely not suitable for fragrance premix compositions according to the present disclosure (at least not in combination with the tested silicones).

Example 3. Miscibility of Certain Silicone Polymers, Aminofunctional Materials, and PRMs In this experiment, different combinations of silicone polymers, aminofunctional materials, and a perfume raw material comprising an aldehyde moiety (at a 99:1:1 weight ratio; a ternary system) are tested according to the Miscibility Test provided in the Test Methods section above. Descriptions for the silicone polymers are provided above in Example 1.

Table 3 shows the results of the Miscibility Test for each of the following combinations. Generally, relatively higher % T value show better miscibility and are preferred, as described in Example 2.

TABLE 3

| | Leg A | Leg B | Leg C |
|---|---|---|---|
| | Silicone (99 parts) | | |
| | DMS-T31 | KF-867S | DMS-A11 |
| | Perfume (1 part) | | |
| Aminofunctional Material (1 part): | Cyclamal | Cyclamal | Cyclamal |
| | % T at 480 nm | | |
| 1. Ethyl hexyl amine | 99.8 | 100.9 | 100.1 |
| 2. Methyl cyclohexyl diamine | 3.8 | 99.5 | 99.8 |
| 3. Butyl ethanol amine | 46.3 | 100.7 | 99.7 |
| 4. PEI-800 Mw | 1 | 1.2 | 50.1 |
| BLANK: | DMS-T31* | KF-867S + Cycl | DMS-A11 + Cycl |

*It has been found that DMS-T31 + cyclamal is relatively cloudy, leading to misleading results when used as the Blank. (Cyclamal includes an aromatic ring and has reduced miscibility with PDMS.)

As shown in Table 3, different ternary systems may have different miscibilities, as evidenced by % T values. Furthermore, even when the silicone and the aminofunctional material are reasonably miscible, the addition of a PRM can have a detrimental effect; see, for example, methyl cyclohexyl diamine (aminofunctional material #2) in Table 2, Leg A vs. Table 3, Leg A.

Also note, for example, the PEI-800 Mw has relatively low miscibility in Legs A and B, as evidenced by low % T values. The % T is relatively higher in Leg C, but the silicone (DMS-A11) has a solubility (as evidenced by amine value and/or Extr. %) that may be undesirably high.

Example 4. Effect of PRM Selection on Miscibility

This experiment shows the relative effects that the selection of certain perfume raw materials may have on the overall miscibility of the ternary system (silicone, aminofunctional material, and perfume raw material). Each leg uses the same silicone polymer (DMS-T31) and a different perfume selection (none, cyclamal, or ligustral); each leg tests the mixture with four aminofunctional materials according to the Miscibility Test provided above (e.g., % T at 480 nm compared to a blank). Structures of cyclamal (i.e., 3-(4-Isopropylphenyl)-2-methylpropanal) and ligustral (i.e., 2,4-Dimethylcyclohex-3-ene-1-carbaldehyde) are provided below.

Cyclamal

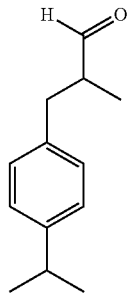

Ligustral

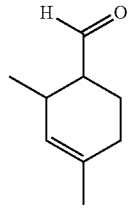

The results are provided in Table 4. Generally, relatively higher % T value show better miscibility and are preferred, as described in Example 2.

TABLE 4

| | Leg A | Leg B | Leg C |
|---|---|---|---|
| | Silicone (99 parts) | | |
| | DMS-T31 | PDMS-T31 | PDMS-T31 |
| | Perfume (1 part) | | |
| Aminofunctional Material (1 part): | - None - | Cyclamal | Ligustral |
| | | % T at 480 nm | |
| 1. Ethyl hexyl amine | 100.2 | 99.8 | 97.9 |
| 2. Methyl cyclohexyl diamine | 85.3 | 3.8 | 52.7 |
| 3. Butyl ethanol amine | 97 | 46.3 | 51.4 |
| 4. PEI-800 Mw | 3.9 | 1 | 5.4 |
| BLANK: | DMS-T31 | DMS-T31 | DMS-T31 + Lig* |

*Ligustral is non-aromatic and is relatively soluble in PDMS, so the binary system can be used as the Blank; compare to Cyclamal, discussed in the previous example.

As shown in Table 4, the selection of one PRM vs. another can have an effect on the miscibility of the ternary system. Compare, for example, Legs A, B, and C for methyl cyclohexyl diamine (aminofunctional material #2) in Table 4.

Again, the % T values for the tests that included PEI-800 Mw are relatively low, indicating low suitability for fragrance premix compositions according to the present disclosure.

Example 5. Exemplary Fragrance Premix Formulations

Table 5 provides exemplary fragrance premix formulations that may be incorporated into consumer products. Amounts are provided as weight percent, by weight of the premix.

TABLE 5

| Ingredient | A | B |
|---|---|---|
| Silicone Polymer[1] | 80 | 45 |
| Aminofunctional material[2] | 5 | 5 |
| Perfume raw materials[3] | 15 | 9 |
| Emulsifier | — | 6 |
| Water | — | 35 |

[1]KF-8003 (ex Shin Etsu)

[2]Methyl cyclohexane diamine (Baxxodur EC210, ex BASF)

[3]Contains ethyl vanillin, vanillin, heliotropin, and lilial, each selected so that each PRM is present in an amount to provide equal moles of aldehyde moieties.

Example 6. Exemplary Method of Making a Fragrance Premix Composition and Subsequent Formulation into a Consumer Product A. Fragrance Premix Composition (non-emulsion)

56.7 grams of an aminofunctional silicone is provided. The aminofunctional silicone is KF-861, supplied by Shin-Etsu Chemical Co., Ltd., and has the following structure:

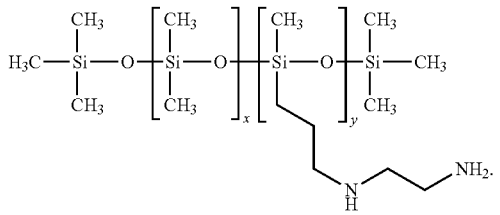

The 56.7 grams of aminofunctional silicone is thoroughly mixed with 3.4 grams of Baxxodur EC 210, supplied by BASF Corporation, using an IKA overhead mixer set to 250 rpm.

The following perfume aldehydes are mixed together in proportions shown in Table 6 to make the "Lilial Accord." The weight (in grams) proportions are selected so as to provide equal molar ratios of aldehyde moieties.

TABLE 6

| Lilial Accord | | | | |
|---|---|---|---|---|
| | Wt (g) | MW (g/mol) | mol | Equiv. |
| Lilial | 3.54 | 204.313 | 0.0173 | 0.25 |
| cyclamal | 3.29 | 190.28 | 0.0173 | 0.25 |
| floralozone | 3.29 | 190.28 | 0.0173 | 0.25 |
| canthoxal | 3.08 | 178.23 | 0.0173 | 0.25 |

13.2 g of the Lilial Accord mixture is added to the aminofunctional silicone/Baxxodur EC 210 mixture thoroughly mixed with overhead mixing with a four-blade impeller for 15 minutes.

B. Consumer Product

The Fragrance Premix Composition (73.3 grams) is combined with 1806.7 grams of molten polyethylene glycol (Pluriol E 8000 Prill supplied by BASF Corporation) and 120.0 grams of fragrance. The blend is mixed and solidified into consumer product particles having an average diameter of about 0.3 cm to about 1.5 cm, and/or an average mass of from about 1 mg to about 1 g.

The resulting consumer product is a plurality of particles that are suitable for addition to the wash cycle of an automatic fabric washing machine, optionally in combination with a laundry detergent. When the consumer product is diluted with water, a plurality of droplets (believed to contain the silicone polymer, the aminofunctional material, and the PRMs of the premix) having a mean diameter of from about 1 micron to about 10 microns is achieved.

Example 7. Exemplary Method of Making a Fragrance Premix Composition in the Form of an Emulsion and Subsequent Formulation into a Consumer Product A. Fragrance Premix Composition (emulsion)

56.7 grams of an aminofunctional silicone is provided. The aminofunctional silicone is KF-861, supplied by Shin-Etsu Chemical Co., Ltd.; the structure is shown in Example 6, above.

The 56.7 grams of aminofunctional silicone is mixed with 3.4 grams of Baxxodur EC 210, supplied by BASF Corporation, 1.0 gram of a nonionic emulsifier (Tergitol 15-S-9 supplied by Dow Chemical Company, Midland, Mich.) and 3.0 grams of a second emulsifier (Surfonic L24-9 supplied by Sasol Chemicals, West Lake, La.), using an IKA overhead mixer set to 250 rpm.

10 grams of water is slowly added and mixed for 15 minutes. Mixing speed is increased slowly as viscosity of the mixture increases. 15 grams of additional water is added slowly while mixing for another 10 minutes at a speed between 300-400 rpm. Mixing speed is lowered if the viscosity of mixture decreases. 11 grams of additional water slowly added while continuing to mix for another 10 minutes. Mixing is continued for another 30 minutes at a speed of about 250 rpm.

The resulting aminofunctional silicone/Baxxodur EC 210 emulsion can be analyzed for droplet size via Horiba using the static cell. For droplet size measurement, the emulsion is diluted to 0.1 wt % emulsion in deionized water (e.g., 0.1 wt parts emulsion, 99.99 wt parts DI water).

13.2 g of the Lilial Accord mixture (see Example 6, above) is slowly added to the aminofunctional silicone emulsion with overhead mixing with a four-blade impeller and gently and thoroughly mixed for 15 minutes. The result is a Fragrance Premix Composition.

B. Consumer Product

The Fragrance Premix Composition Emulsion (113.3 grams) is combined with 1756.6 grams of molten polyethylene glycol (Pluriol E 8000 Prill supplied by BASF Corporation) and 119.8 grams of fragrance. The blend is mixed and solidified into consumer product particles having an average diameter of about 0.3 cm to about 1.5 cm, and/or an average mass of from about 1 mg to about 1 g.

The resulting consumer product is a plurality of particles that are suitable for addition to the wash cycle of an automatic fabric washing machine, optionally in combination with a laundry detergent. When the consumer product is diluted with water, a plurality of droplets (believed to contain the silicone polymer, the aminofunctional material, and the PRMs of the premix) having a mean diameter of from about 1 micron to about 10 microns is achieved.

Example 8. Exemplary Method of Making a Substantially Transparent Fragrance Premix Composition and Subsequent Formulation into Consumer Product A. Fragrance Premix Composition 56.65 grams of an aminofunctional silicone is provided. The aminofunctional silicone is KF-861, supplied by Shin-Etsu Chemical Co., Ltd.; the structure is shown in Example 6, above.

The 56.7 grams of the aminofunctional silicone is thoroughly mixed with 3.4 grams of Baxxodur EC 210, supplied by BASF Corporation, using an IKA overhead mixer set to 250 rpm.

13.2 g of the Lilial Accord mixture (see Example 6, above) is added to the aminofunctional silicone/Baxxodur EC 210 mixture thoroughly mixed with overhead mixing with a four-blade impeller for 15 minutes. The cloudy Fragrance Premix Composition is made substantially transparent under reduced pressure at 40° C. via rotary evaporation.

B. Consumer Product

The substantially transparent Fragrance Premix Composition is combined with 1806.7 grams of molten polyethylene glycol (Pluriol E 8000 Prill supplied by BASF Corporation) and 120.0 grams of fragrance. The blend is mixed and solidified into consumer product particles having an average diameter of about 0.3 cm to about 1.5 cm, and/or an average mass of from about 1 mg to about 1 g.

The resulting consumer product is a plurality of particles that are suitable for addition to the wash cycle of an automatic fabric washing machine, optionally in combination with a laundry detergent. When the consumer product is diluted with water, a plurality of droplets (believed to contain the silicone polymer, the aminofunctional material, and the PRMs of the premix) having a mean diameter of from about 1 micron to about 10 microns is achieved.

Example 9. Performance/Headspace Analysis

The following experiment is performed to demonstrate performance benefits associated with the fragrance premix compositions according to the present disclosure. In sum, two consumer product compositions are made—specifically, liquid fabric conditioning compositions. To one, perfume is added as fragrance premix composition according to the present disclosure; to the other, perfume is added neat. Fabrics are treated with each consumer product composition, and the headspace above the treated fabrics is analyzed for the perfumes. In general, greater amounts of perfume found in the headspace indicate the more perfume was deposited onto, and/or released from, the fabric.

A test perfume accord is made by mixing together the following perfume raw materials in the provided weight ratio.

| PRM | Wt. % |
|---|---|
| Methyl Nonyl Acetaldehyde | 32.5 |
| Delta-Damascone | 32.5 |
| Galbascone | 17.5 |
| Methoxy Phenyl Butanone | 17.5 |

A fragrance premix composition is prepared by combining and mixing 78.91 wt % of aminofunctional silicone KF-867S, supplied by Shin-Etsu Chemical Co., Ltd., 4.27 wt % of aminofunctional material Baxxodur EC 210, supplied by BASF Corporation, and 16.82 wt % of the test perfume accord.

Fabric conditioning compositions are prepared according to the following procedure. A base fabric conditioning composition is provided, which contains a mixture of 9.5 wt % N,N di(tallowoyloxyethyl)-N,N dimethylammonium chloride in water. To one sample of the base fabric conditioning composition, the test perfume accord is added neat; to another sample, the fragrance premix composition is added. Both are added in amounts to provide about 0.3% of total perfume to the final fabric conditioning composition. The mixture is stirred for 15 min with an IKA RW 20 D S1 Mixer, Model RW20D-S1, and IKA R1342 impeller blade at 350 rpm. A structurant and a deposition aid is added, and the mixture is stirred for 10 min. Water is added if needed to standardize the concentration of N,N-di(tallowoyloxyethyl)-N,N dimethylammonium chloride amongst test legs to 8 wt %, and the mixture stirred for 5 min. The pH is adjusted to 2-3 with 1N HCl.

Test fabrics are treated according to the Fabric Treatment Method as provided in the Test Methods section. One fabric set is treated with the fabric conditioning composition made with the test perfume accord provided neat (Sample 1). Another fabric set is treated with the fabric conditioning composition made with the fragrance premix composition (Sample 2).

After treatment, the concentration of the perfume raw materials above each fabric is determined via the Headspace Analysis on Fabric Method. Results are provided in Table 7.

TABLE 7

| | | Headspace Analysis (PRM in nmol/L) | | | | |
|---|---|---|---|---|---|---|
| Sample | Perfume added as: | Methyl Nonyl Acetaldehyde | Delta-Damascone | Galbascone | Methoxy Phenyl Butanone | Total |
| 1 | Neat Accord (comp.) | 5.16 | 0.15 | 0.47 | 0.19 | 5.97 |
| 2 | Fragrance Premix | 11.03 | 7.72 | 0.37 | 0.10 | 19.22 |

As can be seen in Table 7, the fabric treated with the fabric conditioning composition that includes perfume added as the fragrance premix provides more fragrance above fabric than the fabric treated with the comparative composition in which perfume is added as a neat accord (e.g., no silicone/aminofunctional/fragrance premix).

Example 10. Emulsion Benefits

In this example, various benefits of a premix in the form of an emulsion according to the present disclosure are shown, including loading efficiency, droplet size, headspace, and color stability benefits. As discussed in more detail below, emulsion premixes according to the present disclosure are generally preferred with respect to one or more of these benefit vectors.

A. Sample Emulsions

Various perfume emulsions are prepared and tested in subsequent examples. The perfume mixture used in the emulsions is provided in Table 8; the following perfume raw materials are mixed together in the provided weight ratios.

TABLE 8

| PRM | Wt. % |
|---|---|
| Methyl Nonyl Acetaldehyde | 5.263 |
| Delta Damascone | 5.263 |
| Cymal | 5.263 |
| Frambinon Methyl Ether 131479 (methoxy phenyl butanone) | 5.263 |
| Galbascone | 5.263 |
| Ligustral (or Triplal) | 5.263 |
| Iso Cyclo Citral | 5.263 |
| Melonal | 5.263 |
| Calypsone | 5.263 |
| Cuminic Aldehyde | 5.263 |
| Heliotropin | 5.263 |
| Benzaldehyde | 5.263 |
| 3,6-Ivy Carbaldehyde | 5.263 |
| Scentenal | 5.263 |
| Vanillin | 5.263 |
| Ethyl Vanillin | 5.263 |
| Satinaldehyde | 5.263 |
| Canthoxal | 5.263 |
| Anisic Aldehyde | 5.263 |

The perfume mixture of Table 8 is used to prepare the following emulsions, as shown in Table 9. Each emulsion is characterized by a 1:1 molar ratio of aminofunctional groups to ketone-containing perfume raw materials. Emulsions 1-3 are comparative examples; Emulsion 4 is an emulsion premix according to the present disclosure.

TABLE 9

| Ingredients | Emulsion 1 (comp.) | Emulsion 2 (comp.) | Emulsion 3 (comp.) | Example 4 |
|---|---|---|---|---|
| Perfume[1] | 10.74 | 8.12 | 2.62 | 10.74 |
| Amino Functional Polymer[2] | — | 2.99 | — | 2.99 |
| Amino Functional Silicone Polymer[3] | — | — | 50.56 | 50.56 |
| Emulsifier 1[4] | 0.89 | 0.89 | 0.89 | 0.89 |
| Emulsifier 2[5] | 1.79 | 1.79 | 1.79 | 1.79 |
| Water | Balance to 100 wt % | Balance to 100 wt % | Balance to 100 wt % | Balance to 100 wt % |

[1]Test perfume mixture as provided in Table 8
[2]BASF Sokalan Baxxodur ™ 210
[3]Shin-Etsu KF-861 (see Silicone No. 3 in Table 1A, above)
[4]Tergitol ™ 15-S-40 from Dow Chemical Company
[5]Surfonic ™ L24-9 from Sasol Chemicals B. Droplet Size The emulsions of Table 9 above are prepared and mixed using substantially the same mixing energy and time. After mixing, the mean diameter of the droplets of each emulsion is characterized using a Horiba Laser Scattering Particle Size Analyzer (model: LA-950V2). Results are provided in Table 10.

TABLE 10

| Emulsion | Droplet Mean Diameter (microns) | Wt % perfume | Amine:Ketone Mole Ratio |
|---|---|---|---|
| 1 (comp.) | 28.12 | 10.74% | N/A |
| 2 (comp.) | 36.3 | 8.12% | 1 |
| 3 (comp.) | 6.77 | 2.62% | 1 |
| 4 | 3.24 | 10.72% | 1 |

The results in Table 10 (specifically, Emulsion 4) show that emulsions according to the present disclosure can result in emulsions characterized by relatively small droplet sizes while still comprising a relatively high amount of perfume raw material. As mentioned above, it is believed that relatively small droplets (e.g., a mean diameter of about 1 micron to about 10 microns, preferably from about 1 micron to about 5 microns) are preferred for performance and/or stability reasons.

In particular, note that Comparative Emulsion 1 and Emulsion 4 carry the same amount of perfume, but that the droplet size of Emulsion 4 is much smaller. Additionally, the mean droplet diameters of Comparative Emulsion 3 and Emulsion 4 are somewhat similar, but the amount of perfume carried in Emulsion 4 is greater.

C. Performance and Stability in a Pastille

The emulsions of Table 9 are prepared and incorporated into various particulate laundry additives, specifically solid pastille products similar to those sold as DOWNY UNSTOPABLES™ (ex The Procter & Gamble Company). Additionally, one of the formulations includes the active materials of Emulsion 4 added separately (e.g., as individual components, rather than as a premix); see comparative Product 4 below. The emulsions (and separately added materials) are included in such amounts so as to deliver 0.55 wt % of perfume to the final product. The formulations of the different legs are provided below in Table 11.

The products are used to treat fabrics in a mini-washer, and headspace analysis above the treated fabrics is performed to test perfume delivery performance; greater headspace values (as nmol/L) indicate the presence of relatively more perfume. Additionally, color measurements are taken for each product (made fresh), and differences compared to Product 1 are reported as ΔE values; greater ΔE values indicate greater color differences from Product 1, which generally has a white-ish color. In contrast, greater ΔE values in Products 2-5 are associated with yellowing or even brownish coloration.

TABLE 11

| Ingredients | Product 1 (comp.) | Product 2 (comp.) | Product 3 (comp.) | Product 4 (comp.) | Product 5 |
|---|---|---|---|---|---|
| Polyethylene Glycol | 94.88 | 93.23 | 79.01 | 96.71 | 94.88 |
| Fragrance Premix (as provided in Table 8) | 5.12 (Emulsion 1) | 6.77 (Emulsion 2) | 20.99 (Emulsion 3) | — | 5.12 (Emulsion 4) |
| Silicone Polymer | — | — | — | 2.59 | — |
| Amino Functional Material | — | — | — | 0.153 | — |
| Perfume Raw Material | — | — | — | 0.55 | — |
| Headspace Analysis (PRM in nmol/L) | 0.355 | 1.23 | 0.313 | 0.605 | 0.875 |
| Color change vs. Product 1 (fresh) | — | 22.98 | 37.29 | 8.33 | 15.64 |

As shown by the results in Table 11, Product 5 shows the best/most desirable combination of headspace results and color change results. For example, Product 1 (the PRM-only control) shows a relatively desirable color, but also low headspace results. Product 2 shows desirable headspace results, but a relatively high degree of color change. Product 3 shows relatively low headspace results and a high degree of color change; furthermore, a relatively large amount of emulsion is required to deliver the desired amount of perfume. Product 4, in which the materials are added separately, shows relatively low color change, but also less perfume in the headspace compared to Product 5.

D. Performance and Stability in a Liquid Fabric Enhancer

The emulsions of Table 9 are prepared and incorporated into various liquid fabric enhancer products, similar to those sold as liquid DOWNY™ fabric softeners (ex The Procter & Gamble Company). Additionally, one of the formulations includes the active materials of Emulsion 4 added separately (e.g., as individual components, rather than as a premix); see comparative Product 9 below.

The Base Liquid Softener provided in Table 12 comprises about 7 wt % of a diester quat softening material and is free of perfume. The emulsions (and separately added materials) are included in such amounts so as to deliver 0.30 wt % of perfume to the final product. The formulations of the different legs are provided below in Table 12.

The products are used to treat fabrics in a mini-washer, and headspace analysis above the treated fabrics is performed to test perfume delivery performance; greater headspace values (as nmol/L) indicate the presence of relatively more perfume. Additionally, color measurements are taken for each product (made fresh), and differences compared to Product 6 are reported as ΔE values; greater ΔE values indicate greater color differences from Product 6, which generally has a white-ish color. In contrast, greater ΔE values in Products 7-10 are associated with yellowing coloration.

TABLE 12

| Ingredients | Product 6 (comp.) | Product 7 (comp.) | Product 8 (comp.) | Product 9 (comp.) | Product 10 |
|---|---|---|---|---|---|
| Base Liquid Softener | 97.28 | 96.44 | 89.73 | 98.24 | 97.28 |
| Fragrance Premix (as provided in Table 8) | 2.72 (Emulsion 1) | 3.56 (Emulsion 2) | 10.27 (Emulsion 3) | — | 2.72 (Emulsion 4) |
| Silicone Polymer | — | — | — | 1.39 | — |
| Amino Functional Material | — | — | — | 0.08 | — |
| Perfume Raw Material | — | — | — | 0.30 | — |

TABLE 12-continued

| Ingredients | Product 6 (comp.) | Product 7 (comp.) | Product 8 (comp.) | Product 9 (comp.) | Product 10 |
|---|---|---|---|---|---|
| Headspace Analysis (PRM in nmol/L) | 1.85 | 6.29 | 10.52 | 2.12 | 5.04 |
| Color change vs. Product 6 (fresh) | — | 6.43 | 23.61 | (not physically stable) | 11.47 |

As shown in Table 12, Product 10 shows a desirable combination of headspace data, color data, and a relatively low amount of fragrance premix required to delivery the desired amount of perfume.

It is also worth recalling that Comparative Emulsion 2, which is used to make Comparative Product 7, is characterized by a relatively large (and less preferable) mean droplet size; see Table 10 above.

Example 11. Exemplary Product Formulations

The tables below provide formulations of exemplary consumer products that may be formulated with the fragrance premixes of the present disclosure.

Table 13 shows an exemplary liquid fabric conditioning/softener composition that may be made.

TABLE 13

| Ingredient | Wt % |
|---|---|
| Softener active[1] | 9.5% |
| Neat perfume | 1% |
| Perfume (as provided by a fragrance premix acc. to the present disclosure, having 10% PRMs) | 0.2% |
| Deposition aids/Structurant | 0.14% |
| Water and misc. (solvent, pH agent, preservative . . . ) | Balance |

[1]N,N-bis(hydroxyethyl)-N,N-dimethyl ammonium chloride fatty acid ester, produced from C12-C18 fatty acid mixture (REWOQUAT CI-DEEDMAC, ex Evonik)

Table 14 shows exemplary formulations of heavy-duty liquid laundry detergent compositions that may be made according to the present disclosure. Amounts provided are by weight % of active, unless otherwise indicated.

TABLE 14

| | 1 | 2 | 3 | 4 | 5 | 6 | 7 |
|---|---|---|---|---|---|---|---|
| AE18S | 6.77 | 2.16 | 1.36 | 1.30 | | | |
| AE3S | | 3.0 | | | 0.45 | | |
| LAS | 0.86 | 2.06 | 2.72 | 0.68 | 0.95 | | |
| HSAS | 1.85 | 2.63 | 1.02 | | | | |
| AE9 | 6.32 | 9.85 | 10.2 | 7.92 | | | |
| AE8 | | | | | | | 35.45 |
| AE7 | | | | | 8.40 | 12.44 | |
| C1214 dimethyl Amine | 0.3 | 0.73 | 0.23 | 0.37 | | | |
| C1218 Fatty Acid | 0.80 | 1.90 | 0.60 | 0.99 | 1.20 | | 15.00 |
| Citric Acid | 2.50 | 3.96 | 1.88 | 1.98 | 0.9 | 2.5 | 0.6 |
| Optical Brightener 1 | 1.0 | 0.8 | 0.1 | 0.3 | 0.05 | 0.5 | 0.001 |
| Optical Brightener 3 | 0.001 | 0.05 | 0.01 | 0.2 | 0.5 | | |
| Sodium formate | 1.6 | 0.09 | 1.2 | 0.04 | 1.6 | 1.2 | 0.2 |
| DTI 1 | 0.32 | 0.05 | | 0.6 | 0.1 | 0.6 | 0.01 |
| DTI 2 | 0.32 | 0.1 | 0.6 | 0.6 | 0.05 | 0.4 | 0.2 |
| Sodium hydroxide | 2.3 | 3.8 | 1.7 | 1.9 | 1.7 | 2.5 | 2.3 |
| Monoethanolamine | 1.4 | 1.49 | 1.00 | 0.7 | | | |
| Diethylene glycol | 5.5 | | 4.1 | | | | |
| Chelant 1 | 0.15 | 0.15 | 0.11 | 0.07 | 0.5 | 0.11 | 0.8 |
| 4-formyl-phenylboronic acid | | 0.05 | 0.02 | 0.01 | | | |

TABLE 14-continued

| | 1 | 2 | 3 | 4 | 5 | 6 | 7 |
|---|---|---|---|---|---|---|---|
| Sodium tetraborate | 1.43 | 1.50 | 1.10 | 0.75 | | 1.07 | |
| Ethanol | 1.54 | 1.77 | 1.15 | 0.89 | | 3.00 | 7.00 |
| Polymer 1 | 0.1 | | | | | | 2.00 |
| Polymer 2 | 0.3 | 0.33 | 0.23 | 0.17 | | | |
| Polymer 3 | | | | | | | 0.8 |
| Polymer 4 | 0.8 | 0.81 | 0.60 | 0.40 | 1.0 | 1.0 | |
| 1,2-Propanediol | | 6.6 | | 3.3 | 0.5 | 2.0 | 8.0 |
| Structurant | 0.1 | | | | | | 0.1 |
| Perfume (non-premix) | 1.6 | 1.1 | 1.0 | 0.8 | 0.9 | 1.5 | 1.6 |
| Perfume added as premix acc. to present disclosure) | 0.1 | 0.1 | 0.2 | 0.1 | 0.1 | 0.1 | 0.3 |
| Protease | 0.8 | 0.6 | 0.7 | 0.9 | 0.7 | 0.6 | 1.5 |
| Mamanase | 0.7 | 0.05 | 0.045 | 0.06 | 0.04 | 0.045 | 0.1 |
| Amylase 1 | | | 0.3 | 0.1 | | | |
| Amylase 2 | | 0.1 | 0.1 | | 0.07 | | |
| Amylase4 | 0.3 | 0.1 | | 0.15 | 0.03 | 0.4 | 0.1 |
| Isoamylase | 0.3 | 0.2 | 0.1 | 0.07 | 0.2 | 0.02 | 0.3 |
| Xyloglucanase | 0.2 | 0.1 | | | 0.05 | 0.05 | 0.2 |
| Lipase | 0.4 | 0.2 | 0.3 | 0.1 | 0.2 | | |
| Polishing enzyme | | 0.04 | | 0.004 | | | |
| Dispersin B | | | | 0.05 | 0.03 | 0.001 | 0.001 |
| Acid Violet 50 | 0.05 | | | | | | 0.05 |
| Direct Violet 9 | | | | | | 0.05 | |
| Violet DD | | 0.035 | 0.02 | 0.037 | 0.04 | | |
| Water insoluble plant fiber | 0.2 | | | | 1.2 | | |
| Dye control agent | | 0.3 | | 0.5 | 0.3 | | |
| Alkoxylated polyaryl polyalkyl phenol | | | 1.2 | | | | 3.1 |
| Water, dyes & minors | | | | Balance | | | |
| pH | | | | 8.2 | | | |

AE1.85 is C1215 alkyl ethoxy (1.8) sulfate

AE3S is C1215 alkyl ethoxy (3) sulfate

AE7 is C1213 alcohol ethoxylate, with an average degree of ethoxylation of 7

AE8 is C1213 alcohol ethoxylate, with an average degree of ethoxylation of 8

AE9 is C1213 alcohol ethoxylate, with an average degree of ethoxylation of 9

Alkoxylated polyaryl is, for example, EMULSOGEN ® T5160, HOSTAPAL ®BV conc., SAPOGENAT ® T11O, and/or SAPOGENAT ® T139, all from Clariant Amylase 1 is STAINZYME ®, 15 mg active/g Amylase 2 is NATALASE ®, 29 mg active/g Amylase 3 is STAINZYME PLUS ®, 20 mg active/g Isoamylase has glycogen-debranching activity AS is C1214 alkylsulfate Cellulase 2 is CELLUCLEAN ®, 15.6 mg active/g Xyloglucanase is WHITEZYME ®, 20 mg active/g Chelant 1 is diethylene triamine pentaacetic acid (DTPA)

Chelant 2 is 1-hydroxyethane 1,1-diphosphonic acid (HEDP)

Chelant 3 is sodium salt of ethylenediamine-N,N'-disuccinic acid, (S,S) isomer (EDDS)

Dispersin B is a glycoside hydrolase, reported as 1000 mg active/g

DTI 1 is poly(4-vinylpyridine-1-oxide), such as CHROMABOND S-403E ®),

DTI 2 is poly(1-vinylpyrrolidone-co-1-vinylimidazole) (such as SOKALAN HP56 ©).

Dye control agent is, for example, SUPAREX ® O.IN (M1), NYLOFIXAN ® P (M2), NYLOFIXAN ® PM (M3), or NYLOFIXAN ® HF (M4)

HSAS is mid-branched alkyl sulfate as disclosed in U.S. Pat. No. 6,020,303 and U.S. Pat. No. 6,060,443

LAS is linear alkylbenzenesulfonate having an average aliphatic carbon chain length C9-C15 (HLAS is acid form)

Lipase is LIPEX ®, 18 mg active/g Mannanase is MANNAWAY ®, 25 mg active/g Optical Brightener 1 is disodium 4,4'-bis{[4-anilino-6-morpholino-s-triazin-2-yl]-amino}-2,2-stilbenedisulfonate Optical Brightener 2 is disodium 4,4'-bis-(2-sulfostyryl)biphenyl (sodium salt)

Optical Brightener 3 is OPTIBLANC SPL1O ® from 3 V Sigma

Photobleach is a sulfonated zinc phthalocyanine

Polishing enzyme is Para-nitrobenzyl esterase, reported as 1000 mg active/g

Polymer 1 is bis((C2H5O)(C2H4O)n)(CH3) —N —CH—N'—CH3)— bis((C2H50)(C2H40)n), wherein n = 20-30, x = 3 to 8, or sulphated or sulfonated variants thereof Polymer 2 is ethoxylated (EO15) tetraethylene pentamine Polymer 3 is ethoxylated polyethylenimine (PEI600 EO20)

Polymer 4 is ethoxylated hexamethylene diamine

Polymer 5 is ACUSOL ® 305, provided by Rohm&Haas

Polymer 6 is a polyethylene glycol polymer grafted with vinyl acetate side chains, provided by BASF Protease is PURAFECT PRIME ® 40.6 mg active/g Protease 2 is SAVINASE ®, 32.89 mg active/g Protease 3 is PURAFECT ®, 84 mg active/g Quaternary ammonium is C1214 Dimethylhydroxyethyl ammonium chloride S-ACMC is Reactive Blue 19 Azo-CM-Cellulose, provided by Megazyme Soil release agent is REPEL-O-TEX ® SF2

Structurant is Hydrogenated Castor Oil

Violet DD is a thiophene azo dye provided by Milliken

Water insoluble plant material is, for example, Herbacel AQ+ Type N, supplied by Herbafood Ingredients GmbH, Werder, Germany Table 15 shows formulations of various unit dose detergent articles in the form of pouches. Multi-compartment pouches can contain a plurality of benefit agents. By way of a non-limiting example, a two- or three-component pouch may contain the formulations presented in Table 15 in separate enclosures, where dosage is the amount of the formulation in the respective enclosure. The pouch may be formed from a water-soluble film, such as polyvinyl alcohol films available from MonoSol, LLC (Indiana, USA).

TABLE 15

| | A 3 compartments | | | B 2 compartments | | C 3 compartments | | |
|---|---|---|---|---|---|---|---|---|
| Compartment # | 1 | 2 | 3 | 1 | 2 | 1 | 2 | 3 |
| Dosage (g) | 34.0 | 3.5 | 3.5 | 30.0 | 5.0 | 25.0 | 1.5 | 4.0 |
| Ingredients | Weight % | | | | | | | |
| Alkylbenzen esulfonic acid | 20.0 | 20.0 | 20.0 | 10.0 | 20.0 | 20.0 | | |
| Alkyl sulfate | | | | 2.0 | | | | |
| C12-14 alkyl 7-ethoxylate | 17.0 | 17.0 | 17.0 | | 17.0 | 17.0 | | |
| Cationic surfactant | | | | 1.0 | | | | |
| Zeolite A | | | | 10.0 | | | | |
| C12-18 Fatty acid | 13.0 | 13.0 | 13.0 | | 18.0 | 18.0 | | |
| Sodium acetate | | | | 4.0 | | | | |
| enzymes | 0-3 | 0-3 | 0-3 | 0-3 | | 0-3 | | |
| Sodium Percarbonate | | | | 11.0 | | | | |
| TAED | | | | 4.0 | | | | |
| Organic catalyst [1] | | | | 1.0 | | | | |
| PAP granule [2] | | | | | | | | 50 |
| Polycarboxylate | | | | 1.0 | | | | |
| Polyethyleneimine ethoxylate [3] | 2.2 | 2.2 | 2.2 | | | | | |
| Hydroxyethane diphosphonic acid | 0.6 | 0.6 | 0.6 | 0.5 | | | | |
| Ethylene diamine tetra(methylene phosphonic) acid | | | | | | 0.4 | | |
| Brightener | 0.2 | 0.2 | 0.2 | 0.3 | | 0.3 | | |
| Mineral oil | | | | | | | | |
| Hueing dye [4] | | | 0.05 | | 0.035 | | 0.12 | |
| Perfume (neat) | 1.7 | 1.7 | | 0.6 | | 1.5 | | |
| Fragrance Premix* (acc. to present disclosure; 17 wt % PRMs) | 3 | | | 2.5 | | 3 | | |
| Water and minors (antioxidant, aesthetics, etc.) | 10.0 | 10.0 | 10.0 | 4.0 | | | | |
| Buffers (sodium carbonate, monoethanolamine) [5] | To pH 8.0 for liquids To RA > 5.0 for powders | | | | | | | |
| Solvents (1,2 propanediol, ethanol) for liquids, sodium sulfate for powders | To 100% | | | | | | | |

[1] Sulfuric acid mono-[2-(3,4-dihydro-isoquinolin-2-yl)-1-(2-ethyl-hexyloxymethyl)-ethyl]ester as described in U.S. Pat. No. 7,169,744

[2] PAP = Phtaloyl-Amino-Peroxycaproic acid, as a 70% active wet cake

[3] Polyethylenimine (MW = 600) with 20 ethoxylate groups per —NH.

[4] Ethoxylated thiophene, EO ($R_1 + R_2$) = 5

[5] RA = Reserve Alkalinity (g NaOH/dose)

* wt % provided in table is the amount of fragrance premix provided, not the amount of perfume delivered by the premix; premix is substantially free of water The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A fragrance premix composition comprising:

from about 30% to about 98%, by weight of the fragrance premix composition, of a silicone polymer, wherein the silicone polymer is characterized by an amine value of from 0.0 to about 3 meq/g;

from about 1% to about 20%, by weight of the fragrance premix composition, of an aminofunctional material, wherein the aminofunctional material is characterized by a molecular weight of less than about 1000 Daltons, and wherein the aminofunctional material comprises at least one amine moiety selected from a primary amine moiety, a secondary amine moiety, or a combination thereof; and from about 0.5% to about 25%, by weight of the fragrance premix composition, of a fragrance material comprising one or more perfume raw materials, wherein the one or more perfume raw materials comprises an aldehyde moiety, a ketone moiety, or combinations thereof;

wherein a mixture of the silicone polymer, the aminofunctional material, and the one or more perfume materials in a 9.9:0.1:0.1 weight ratio is characterized by a % Transmittance (% T) of at least 40 at 480 nm.

2. The fragrance premix composition according to claim 1, wherein the silicone polymer is characterized by an Extraction Percentage (Extr. %) of less than 5% after 24 hours.

3. The fragrance premix composition according to claim 1, wherein the silicone polymer is characterized by a solubility in water of less than about 800 mg/L, measured at 25° C.

4. The fragrance premix composition according to claim 1, where in the silicone polymer is characterized by a total amine value of from about 0.05 to about 3 meq/g.

5. The fragrance premix composition according to claim 1, wherein the silicone polymer comprises a cyclic silicone, a polydimethylsiloxane (PDMS) polymer, an aminofunctional silicone polymer, or a mixture thereof.

6. The fragrance premix composition according to claim 1, wherein the aminofunctional material is characterized by one or both of the following:

(a) an Amine Equivalent Weight of about 25 to 300 g/mol; and/or (b) a Hydrophilic Group Equivalent Weight of greater than 100.

7. The fragrance premix composition according to claim 1, wherein the aminofunctional material is selected from the group consisting of:

(a) an aliphatic aminofunctional material;

(b) a cycloaliphatic aminofunctional material;

(c) an aminofunctional silane;

(d) an aminoalcohol where a primary amine moiety or secondary amine moiety is separated by two carbon atoms from a hydroxyl group;

(e) 1,3-bis(3-aminopropyl) tetramethyldisiloxane; or (f) mixtures thereof.

8. The fragrance premix composition according to claim 1, wherein the one or more perfume raw materials comprise an aldehyde moiety.

9. The fragrance premix composition according to claim 1, wherein the one or more perfume raw materials comprise a ketone moiety.

10. The fragrance premix composition according to claim 1, wherein the one or more perfume raw materials comprise a material selected from the following:

a. oncidal, methyl nonyl acetaldehyde, adoxal, melanal, calypsone, or mixtures thereof;

b. cuminic aldehyde, benzaldehyde, anisic aldehyde, heliotropin, isocyclocitral, triplal/ligustral, 3,6-ivy carbaldehyde, ligustral, scentenal, or mixtures thereof;

c. satinaldehyde (jasmorange), otropal, cyclamen homoaldehyde, cyclamen aldehyde (cyclamal), lilial, canthoxal, floralozone, cinnemic aldehyde, or mixtures thereof;

d. delta-damascone, beta-damascone, alpha-damascone, nectaryl, or mixtures thereof;

e. vanillin; ethyl vanillin; octahydro-4,7-methano-1H-indene-5-acetaldehyde; 3-[4-(2-methylpropyl)cyclohexyl]propanal; or mixtures thereof; or f. a combination of materials selected from at least two categories of a, b, c, d, and e.

11. The fragrance premix composition according to claim 1, (a) wherein the total moles of primary and secondary amine moieties present in the composition as provided by the silicone polymer and the aminofunctional material is X, (b) wherein the total moles of aldehyde moieties and/or ketone moieties present in the composition as provided by the one or more perfume raw materials is Y, and (c) wherein the ratio of X:Y is from about 2:1 to about 1:20.

12. The fragrance premix composition according to claim 1, wherein the fragrance premix composition comprises:

from about 40% to about 95%, by weight of the fragrance premix composition, of the silicone polymer; or from about 2% to about 15%, by weight of the fragrance premix composition, of the aminofunctional material; or from about 1% to about 20%, by weight of the fragrance premix composition, of the one or more perfume raw materials; or a combination thereof.

13. The fragrance premix composition according to claim 1, wherein the mixture of the silicone compound, the aminofunctional material, and the one or more perfume materials in a 9.9:0.1:0.1 weight ratio is characterized by a % Transmittance (% T) at 480 nm of at least 50.

14. The fragrance premix composition according to claim 1, wherein the fragrance premix composition comprises from about 1% to about 90%, by weight of the composition, of water.

* * * * *